US006782219B2

(12) United States Patent
Yoshino et al.

(10) Patent No.: US 6,782,219 B2
(45) Date of Patent: Aug. 24, 2004

(54) CARTRIDGE AND ELECTROPHOTOGRAPHIC IMAGE FORMING APPARATUS

(75) Inventors: Yasufumi Yoshino, Numazu (JP); Hironobu Isobe, Numazu (JP); Koji Yamaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/179,254

(22) Filed: Jun. 26, 2002

(65) Prior Publication Data

US 2003/0223775 A1 Dec. 4, 2003

(30) Foreign Application Priority Data

May 31, 2002 (JP) ..... 2002/160744

(51) Int. Cl.[7] ..... G03G 15/00; G03G 15/01; G03G 15/08

(52) U.S. Cl. ..... 399/90; 399/112; 399/113; 399/119

(58) Field of Search ..... 399/119, 120, 399/112, 111, 90, 223, 226, 227, 113; 347/115, 138, 152

(56) References Cited

U.S. PATENT DOCUMENTS

| | | | | |
|---|---|---|---|---|
| 5,331,373 A | | 7/1994 | Nomura et al. | 399/111 |
| 5,452,056 A | | 9/1995 | Nomura et al. | 399/111 |
| 5,585,889 A | | 12/1996 | Shishido et al. | 399/113 |
| 5,870,655 A | | 2/1999 | Nishiuwatoko et al. | 399/111 |
| 5,940,657 A | | 8/1999 | Yokomori et al. | 399/119 |
| 5,995,782 A | * | 11/1999 | Isobe et al. | 399/119 |
| 6,064,843 A | | 5/2000 | Isobe et al. | 399/111 |
| 6,072,969 A | | 6/2000 | Yokomori et al. | 399/119 |
| 6,097,906 A | * | 8/2000 | Matsuzaki et al. | 399/90 |
| 6,128,452 A | * | 10/2000 | Miyabe et al. | 399/90 |
| 6,226,478 B1 | | 5/2001 | Watanabe et al. | 399/117 |
| 6,249,663 B1 | * | 6/2001 | Alzawa et al. | 399/111 X |
| 6,308,028 B1 | | 10/2001 | Yashiro et al. | 399/111 |
| 6,311,026 B1 | | 10/2001 | Higeta et al. | 399/13 |
| 6,324,370 B1 | | 11/2001 | Isobe et al. | 399/258 |
| 6,442,359 B1 | | 8/2002 | Numagami et al. | 399/111 |

FOREIGN PATENT DOCUMENTS

| | | |
|---|---|---|
| EP | 0 827 049 | 8/1997 |
| JP | 2-163761 | 6/1990 |
| JP | 9-297443 | 11/1997 |

OTHER PUBLICATIONS

Patent Abstracts of Japan, vol. 14, No. 422, Sep. 12, 1990 (JP 2–163761).

* cited by examiner

*Primary Examiner*—Sophia S. Chen
(74) *Attorney, Agent, or Firm*—Fitzpatrick, Cella, Harper & Scinto

(57) ABSTRACT

A cartridge detachably mountable to a main assembly of an electrophotographic image forming apparatus includes a cartridge frame; a developing member for developing an electrostatic latent image formed on an electrophotographic photosensitive member; a first guide, provided projected outwardly of the cartridge frame at one longitudinal end side of the developing member, for guiding the cartridge when the cartridge is mounted to the main assembly of the apparatus a second guide, provided projected outwardly of the cartridge frame at the other longitudinal end side of the developing member, for guiding the cartridge when the cartridge is mounted to the main assembly of the apparatus; and a developing bias contact, provided exposed on the first guide for receiving a developing bias to be applied to the developing member from the main assembly of the apparatus when the cartridge is mounted to the main assembly of the apparatus.

21 Claims, 24 Drawing Sheets

CARTRIDGE AND ELECTROPHOTOGRAPHIC IMAGE FORMING APPARATUS

FIELD OF THE INVENTION AND RELATED ART

The present invention relates to a cartridge and an electrophotographic image forming apparatus to which the cartridge is detachably mountable.

The present invention is suitably used with developing means for developing an electrostatic latent image formed on an electrophotographic photosensitive member into a visualized image (toner image), a rotary type developing device in which a plurality of cartridge type developing devices (developing cartridges) are carried on a rotary, a developing cartridge detachably mountable to such a developing device, and an electrophotographic image forming apparatus provided with such a developing device. The present invention is particularly suitable for a color electrophotographic image forming apparatus.

Here, the electrophotographic image forming apparatus is an apparatus for forming an image on a recording material through an electrophotographic image forming process. For example, it is an electrophotographic copying machine, an electrophotographic printer (LED printer, laser beam printer), an electrophotographic printer type facsimile machine, an electrophotographic printer type word processor and the like.

It is known that a developing member for developing an electrostatic latent image on the electrophotographic photosensitive member and a toner accommodating portion for accommodating a developer (toner) are unified by a cartridge frame into a cartridge which is detachably mountable to the main assembly of the image forming apparatus (developing cartridge type).

Also, a process cartridge type is known in which an electrophotographic photosensitive member and process means actable on the electrophotographic photosensitive member are unified into a cartridge which is detachably mountable to the main assembly of the image forming apparatus.

According to such a cartridge type, the operationality can be remarkably improved because the maintenance operation of the apparatus can be carried out in effect by the user without a serviceman. Therefore, the cartridge type is widely used in the image forming apparatus.

The cartridge contains developing means for applying toner to the latent image formed on the photosensitive drum. The developing means comprises a developing roller functioning as a developing member for feeding the toner to the photosensitive drum, a toner supplying roller functioning as a developer application member for supplying the toner onto the developing roller, a developing blade functioning as a developer amount regulating member for regulating an amount of the developer on the developing roller and so on. Such members a unified with a toner frame which accommodates the toner and which is supported on a developing device frame, so that a cartridge frame is constituted.

In an apparatus which forms an image through the electrophotographic type process, a photosensitive drum uniformly charged by a charging device is selectively exposed to light to form an electrostatic latent image, and the electrostatic latent image is visualized with the toner by the developing means. The toner image is then transferred onto a recording material.

In order to apply a predetermined bias voltage to the toner, the developing roller has to be supplied with a predetermined bias voltage.

Heretofore, a developing bias electrical contact provided on a longitudinal end surface of the cartridge or a developing bias contact provided on the bottom surface of the cartridge contact the developing bias contact provided in the main assembly of the image forming apparatus. The present invention provides a further development of such art.

SUMMARY OF THE INVENTION

Accordingly, it is a principal object of the present invention to provide a cartridge and an electrophotographic image forming apparatus the cartridge having mounting and demounting operability relative to the main assembly of the apparatus.

It is another object of the present invention to provide a cartridge and an electrophotographic image forming apparatus wherein the electrical connection between the electric contacts of the main assembly and the cartridge can be assuredly established when the cartridge is mounted to the main assembly of the electrophotographic image forming apparatus in place.

It is a further object of the present invention to provide a cartridge and an electrophotographic image forming apparatus wherein when the cartridge is mounted to the main assembly of the electrophotographic image forming apparatus, the relative positional accuracy between the electrical contact of the cartridge and the electrical contact of the main assembly of the apparatus is improved.

It is a further object of the present invention to provide a cartridge and an electrophotographic image forming apparatus wherein when the cartridge is mounted to the main assembly of the electrophotographic image forming apparatus, the contact pressure between the electrical contact of the cartridge and the electrical contact of the main assembly of the apparatus is improved. It is a further object of the present invention to provide a cartridge and an electrophotographic image forming apparatus wherein an electrical contact is provided on a guide for guiding a cartridge when the cartridge is mounted to the main assembly of the electrophotographic image forming apparatus.

It is a further object of the present invention to provide a cartridge and an electrophotographic image forming apparatus wherein the distance between a developing bias contact of the main assembly of the image forming apparatus and a developing bias contact of the cartridge is maintained constant to assure a constant contact pressure while improving the operability.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, cartridges and electrophotographic image forming apparatuses in accordance with the present invention will be described with reference to the appended drawings.

Embodiment 1

Figure 1:
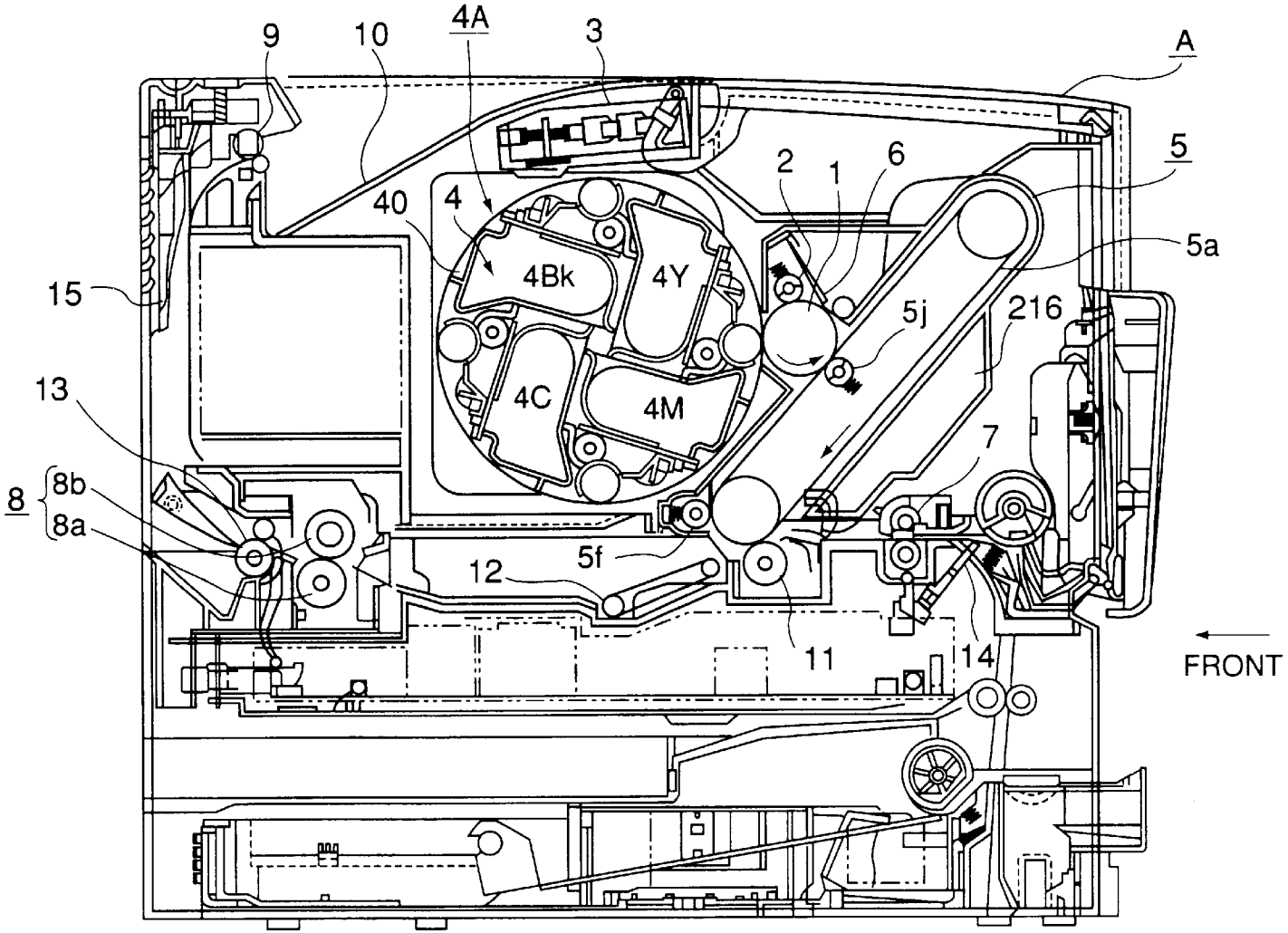
FIG. 1 is a sectional view of a main assembly of a color image forming apparatus of an electrophographic type according to an embodiment of the present invention.

FIG. 1 shows an embodiment of an electrophotographic image forming apparatus in accordance with the present invention, which is an electrophotographic color image forming apparatus, more specifically, a color laser beam printer. In the terms of the direction in which recording medium following descriptions of the embodiments of the present invention, the "front side" means the upstream surface (right side in FIG. 1) of the apparatus in terms of the direction in which recording medium (transfer medium) is conveyed from the transfer station to the fixation station. The "left or right side" means the left or right side as seen from the front side of the apparatus. Further, the "lengthwise direction" means the direction which is parallel to the surface of a recording medium, and perpendicular (virtually perpendicular) to the direction in which the recording medium is conveyed.

(General Structure of Electrophotographic Color Image Forming Apparatus)

First, referring to FIGS. 1 and 2, the general structure of an electrophotographic color image forming apparatus A will be described.

In this embodiment, the color laser beam printer A comprises a process cartridge 5, which is removably mounted in the main assembly of the image forming apparatus A. The process cartridge 5 comprises: four development cartridges 4, which are a yellow development device 4Y, a magenta development device 4M, a cyan development device 4C, and a black development device 4BK, one for one; a photoconductive drum unit 20; and an intermediary transfer member unit 21.

Referring to FIG. 1, in the image forming apparatus main assembly, an image bearing member (which hereinafter will be referred to as a "photoconductive drum") is uniformly charged by a charging apparatus 2, and a latent image is formed on the uniformly charged photoconductive drum by projecting from an exposing means 3, an optical image in accordance with image formation data. The latent image is turned into a visible image (which hereinafter will be referred to as a "toner image") by the development cartridge 4, which constitutes a development apparatus 4A. Then, the toner image is transferred onto an intermediary transfer medium or belt 5*a* by a first transferring means 5*j*, which constitutes a transferring apparatus.

Next, the toner image on the intermediary transfer medium member 5*a* is transferred by a second transferring means 11 onto a transfer medium being conveyed by a conveying means in synchronism with the formation of the toner image. Then, the transfer medium is conveyed into a fixing means 8 having a pressure roller 8*a* and a heat roller 8*b*. In the fixing means 8, the toner image on the transfer medium is fixed to the transfer medium. Then, the transfer medium is discharged into a delivery portion 10.

Figure 2:
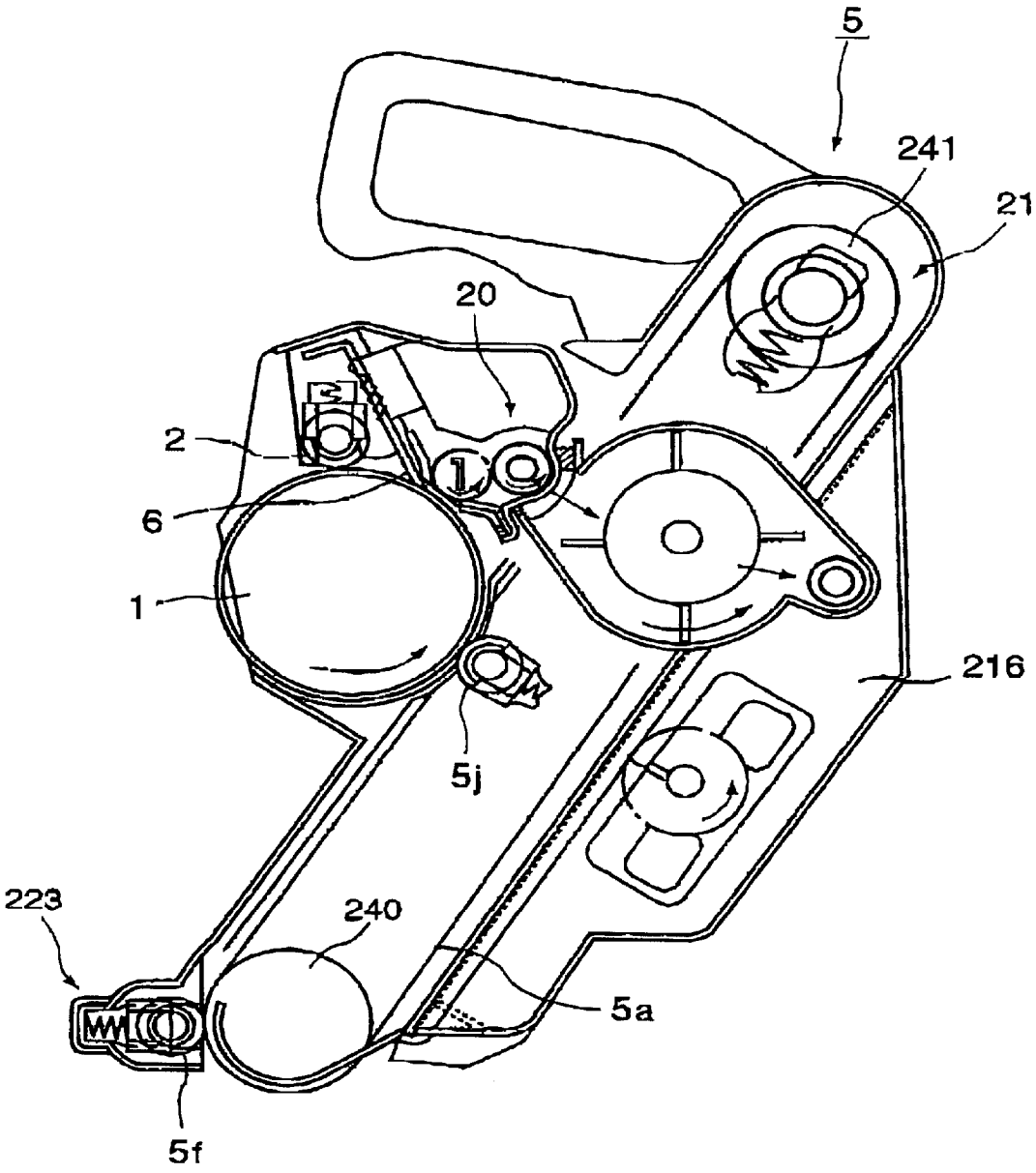
FIG. 2 is a major sectional view of a process cartridge mountable to a color image forming apparatus according to an embodiment of the present invention.

To describe further referring to FIG. 2, in this embodiment, the photoconductive drum 1, the intermediary transfer belt 5*a*, and a waste toner box 216 together make up the process cartridge 5 of an integral type. In other words, the process cartridge 5 is made up of two units: the photoconductive drum unit 20 comprising the photoconductive drum 1, and the intermediary transfer medium unit 21 comprising the intermediary transfer belt 5*a* and waste toner box 216.

The intermediary transfer belt unit 21 has a means (intermediary transferring means) for transferring the image onto the transfer medium after the transfer of the image from the photoconductive drum 1 onto the intermediary transfer belt 5*a*, and a means (waste toner recovering/storing means) for recovering and storing the waste toner.

The intermediary transfer belt 5*a* is stretched and suspended around two rollers: a driving roller 240 and a follower roller 241. The process cartridge 5 is provided with the primary transfer roller 5*j*, which opposes the photoconductive drum 1, with the interposition of the intermediary transfer belt 5*a* between the transfer roller 5*j* and photoconductive drum 1.

Opposing the driving roller 240 with the interposition of the intermediary transfer belt 5*a* is a cleaning charge roller portion 223 for removing residual electrical charge from the residual toner particles remaining on the intermediary transfer belt 5*a* by applying a predetermined bias voltage.

To the cleaning charge roller 5*f*, a predetermined bias voltage is applied to remove the residual electrical charge from the residual toner particles. Then, the residual toner particles are electrostatically transferred back onto the photoconductive drum 1, and are removed (recovered) by a cleaning blade 6 to be accumulated in the waste toner box 216, as described before.

Next, referring again to FIGS. 1 and 2, the image formation processes in the image forming apparatus structured as described above will be described in more detail.

The photoconductive drum 1 is rotated in the direction (counterclockwise) of the arrow mark in FIG. 1 in synchronism with the rotation of the intermediary transfer belt 5*a*. The peripheral surface of the photoconductive drum 1 is uniformly charged by applying a predetermined charge bias voltage to the charge roller 2 as a charging apparatus. Then, the peripheral surface of the photoconductive drum 1 is exposed by the exposing means 3; it is exposed to the optical image of the yellow color component, for example, of an intended image. As a result, an electrostatic latent image corresponding to the yellow color component of the intended image is formed on the peripheral surface of the photoconductive drum 1.

The exposing means 3 is a means which exposes the peripheral surface of the photoconductive drum 1 to an optical image in accordance with the image formation data read from an external apparatus or the like, by projecting the optical image onto the photoconductive drum 1. It comprises a laser diode, a polygon mirror, a scanner motor, a focusing lens, and a deflection mirror.

As image signals are given to the exposing means 3 from an external device or the like, the laser diode emits light, as image formation light, in accordance with the image signals, and the light is projected toward the polygon mirror which is being rotated at a high speed by the scanner motor. The projected light is deflected by the polygon mirror, passed through the focusing lens, deflected by the deflection mirror, and selectively exposes the peripheral surface of the photoconductive drum 1. As a result, an electrostatic latent image is formed on the photoconductive drum 1.

The electrostatic latent image on the photoconductive drum 1 is turned into a toner image of a predetermined color, by the development cartridge 4, which in this embodiment is the developing apparatus A of the so-called rotary type. The developing apparatus A comprises: four development devices, that is, the yellow development device 4Y, magenta development device 4M, cyan development device 4C, and the development device 4BK; and a rotary 40 in which the four development devices are mounted to be moved to the development position, at which a predetermined development device opposes the photoconductive drum 1.

In other words, in this embodiment, at the same time as the formation of an electrostatic latent image, a predetermined cartridge, for example, the yellow development device 4Y, of the developing apparatus 4A, is moved by the rotation of the rotary 40 to the development position, at which a predetermined bias is applied to develop the electrostatic latent image by adhering yellow toner to the electrostatic latent image.

Figure 3:
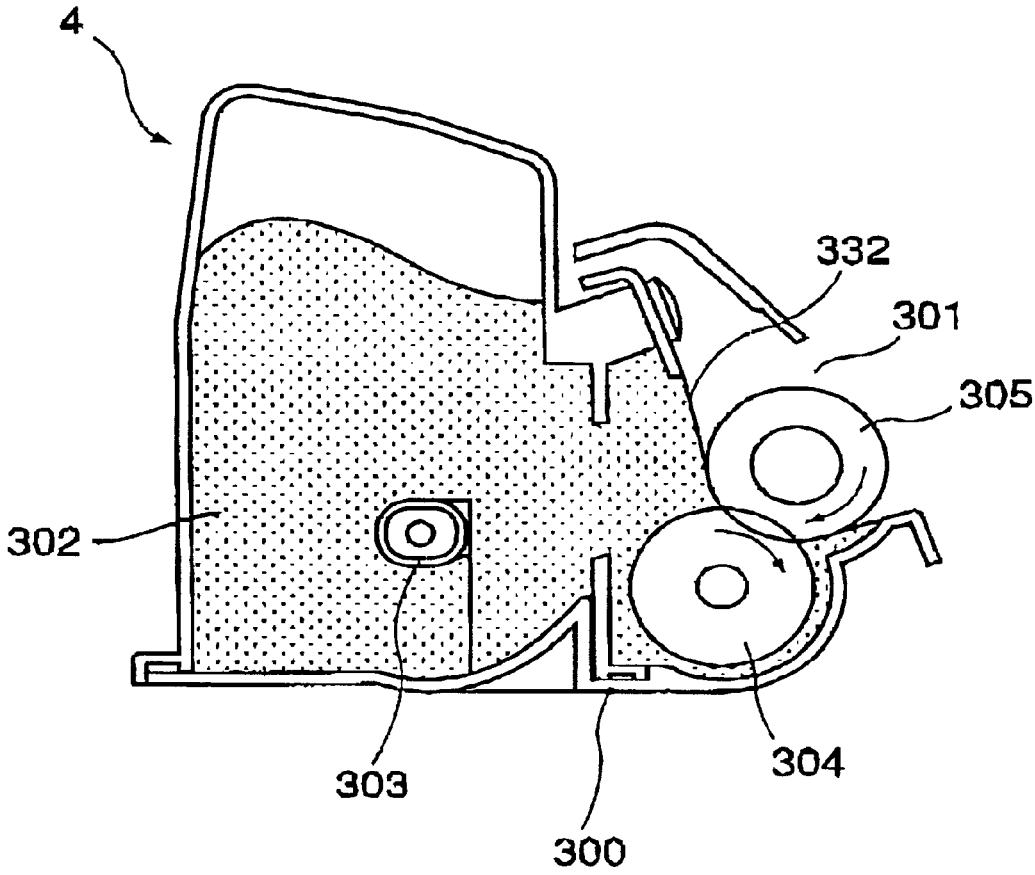
FIG. 3 is a sectional view of a developing cartridge according to Embodiment 1 of the present invention.

Referring to FIG. 3, the development cartridge 4 can be roughly divided into a toner storage portion 302 as a toner container, and a development portion 301 which opposes the photoconductive drum 1. The toner storage portion 302 and development portion 301 are united by the cartridge frame 300.

The toner storage portion 302 is filled with a toner of a predetermined color. As a stirring means 303 is rotated, a predetermined amount of the toner in the toner storage portion 302 is conveyed to the development portion 301. In the development portion 301, as the spongy toner supply roller 304 is rotated, the toner is supplied to the peripheral surface of a development roller 305, and the thickness of the toner layer on the development roller 305 is reduced to a predetermined one by a development blade 332 in the form of a piece of thin plate, while the toner particles are rubbed against the development blade 332 and development roller 305, being thereby electrically charged. The thin layer of the toner on the development roller 305 is conveyed by the rotation of the development roller 305 to the development portion 301, in which a predetermined development bias is applied to develop the electrostatic latent image on the photoconductive drum 1 into a toner image, or a visible image.

The residual toner particles, that is, the toner particles which did not contribute to the visualization of the latent image on the photoconductive drum 1, and remaining on the peripheral surface of the development roller 305, are scraped away by the toner supply roller 304, while a fresh supply of toner is supplied to the peripheral surface of the development roller 305 by the toner supply roller 304 for the development of the latent image continually formed on the photoconductive drum 1.

Referring again to FIGS. 1 and 2, after the development, the toner image, for example, the toner of yellow color, on the photoconductive drum 1 is transferred (primary transfer) onto the intermediary transfer belt 5*a* by applying a bias voltage, the polarity of which is opposite to that of the toner, to the primary transfer roller 5*j* as the first transferring means, which constitutes a means for keeping the intermediary transfer belt 5*a* pressed against the photoconductive drum 1.

As the above described primary transfer of the yellow toner image is completed, the next development device, which in this embodiment is the magenta development device 4M, is moved by the rotation of the rotary 40 to the development portion, at which the magenta development device 4M opposes the photoconductive drum 1, and transfers a toner image of magenta color onto the intermediary transfer belt 5*a*. The above described process is also repeated for the cyan and black color components. As a result, four color toner images are placed in layers on the intermediary transfer belt 5*a*.

Meanwhile, the secondary transfer roller 11 as the second transferring means remains in noncontact with the intermediary transfer belt 5*a*, and the cleaning charge roller 5*f* is kept at a location at which it does not contact the intermediary transfer belt 5*a*.

As the four color toner images different in color are placed on the intermediary transfer belt 5*a*, the second transfer roller 11 is pressed against the intermediary transfer belt 5*a* as shown in FIG. 1. Further, in synchronism with the pressing of the secondary transfer roller 11 against the intermediary transfer belt 5*a*, a transfer medium, which has been kept on standby at a predetermined location near a registration roller pair 7 as a conveying means, is released to be sent into the nip portion between the intermediary transfer belt 5*a* and secondary transfer roller 11.

On the immediately upstream side of the registration roller pair 7, an upstream registration sensor 14 is disposed, which keeps the transfer medium on standby by shutting off the force for rotationally driving the registration roller pair 7 upon detection of the leading end of the transfer medium.

To the secondary transfer roller 11, a bias voltage, the polarity of which is opposite to that of the toner, is being applied, and the toner images on the intermediary transfer belt 5*a* are transferred (secondary transfer) all at once onto the surface of the transfer medium as the transfer medium is conveyed into the aforementioned nip portion.

After the transfer (secondary transfer) of the toner images, the transfer medium is conveyed by a conveyer belt unit 12 to the fixing device 8, in which the toner images are fixed. Then, the transfer medium is conveyed along the sheet discharge guide 15 by a sheet discharge roller pair 13, and is discharged into a delivery tray 10 at the top of the color image forming apparatus by a sheet discharge roller pair 9, ending the image formation.

Meanwhile, after the completion of the secondary transfer, the cleaning charge roller 5*f* is pressed against the intermediary transfer belt 5*a*, and a predetermined bias voltage is applied to the cleaning charge roller 5*f*, removing residual electrical charge from the surface of the intermediary transfer belt 5*a*, and the toner particles (secondary residual toner particles) remaining on the intermediary transfer belt 5*a*.

After the removal of electrical charge, the residual toner particles are electrostatically transferred back onto the photoconductive drum 1 from the intermediary transfer belt 5*a*, in the primary transfer nip portion; in other words, the surface of the intermediary transfer belt 5*a* is cleaned.

After being transferred back onto the photoconductive drum 1, the secondary transfer residual toner particles are removed (recovered) by the cleaning blade 6 for cleaning the photoconductive drum 1. The recovered transfer residual toner particles are sent as waste toner through a conveyance path (unshown), and are accumulated in the waste toner box 216.

(Rotary, Development Cartridge, and Developing Apparatus)

Next, referring to FIGS. 4–13, the development cartridge 4 and developing apparatus A will be described.

As described above, the development cartridges 4, that is, yellow development device 4Y, magenta development device 4M, cyan development device 4C, and black development device 4BK, in which yellow, magenta, cyan, and black toners are stored, respectively, are placed in the predetermined positions in the rotary 40 of the developing apparatus 4A.

At this time, the method for positioning the development cartridges 4 in the rotary 40 will be described.

Figure 11:
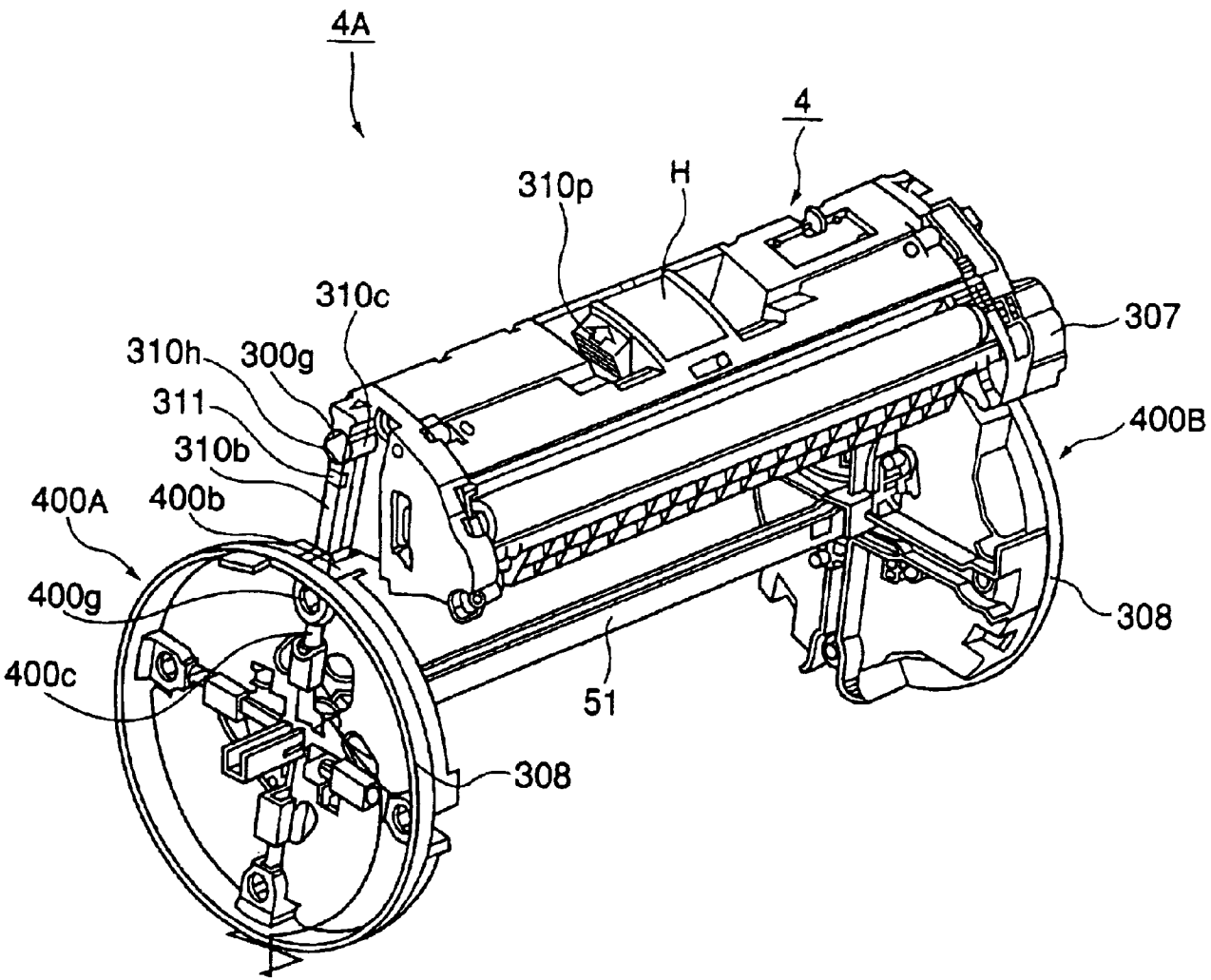
FIG. 11 is a perspective view illustrating mounting of a developing cartridge onto a rotary of the main assembly of the apparatus according to Embodiment 1.
Figure 12:
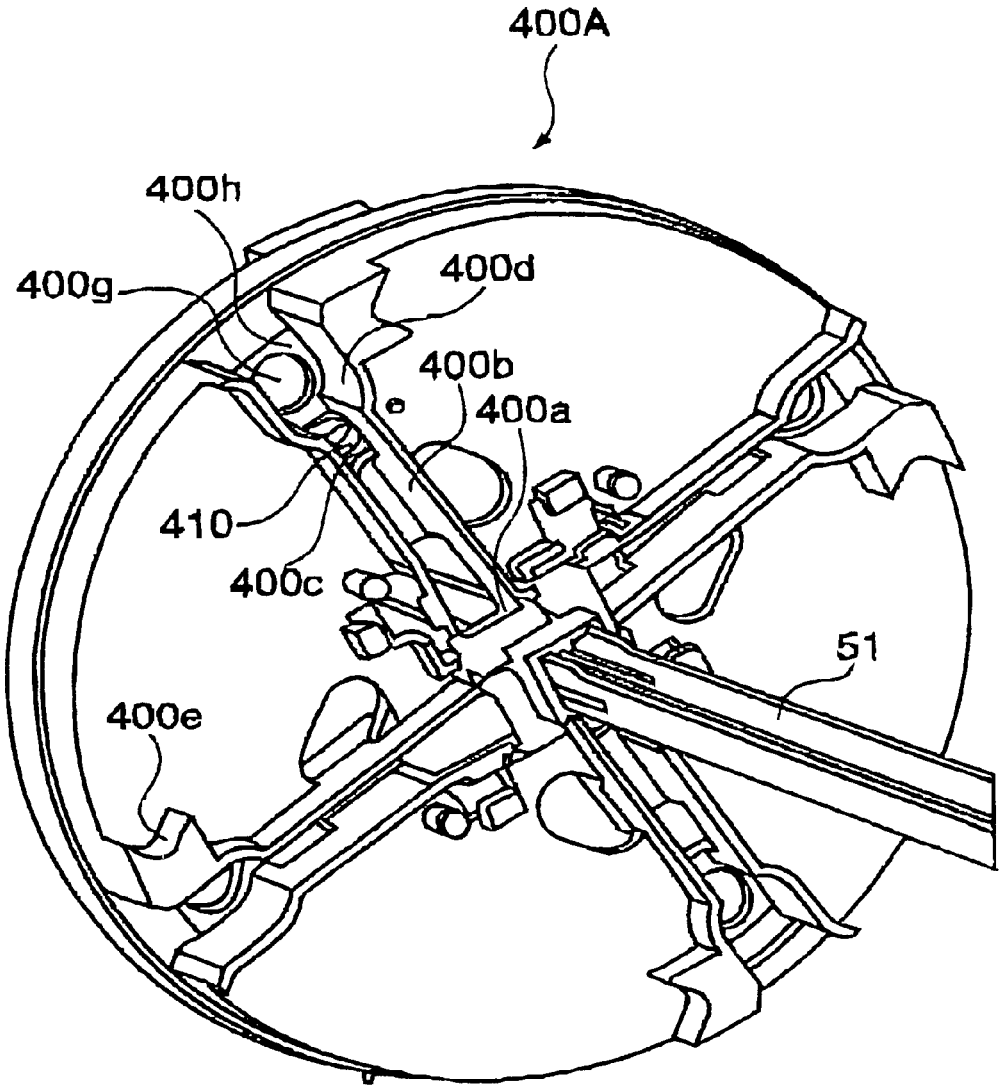
FIG. 12 is a perspective view illustrating a developing cartridge mounting structure of a rotary disk.
Figure 13:
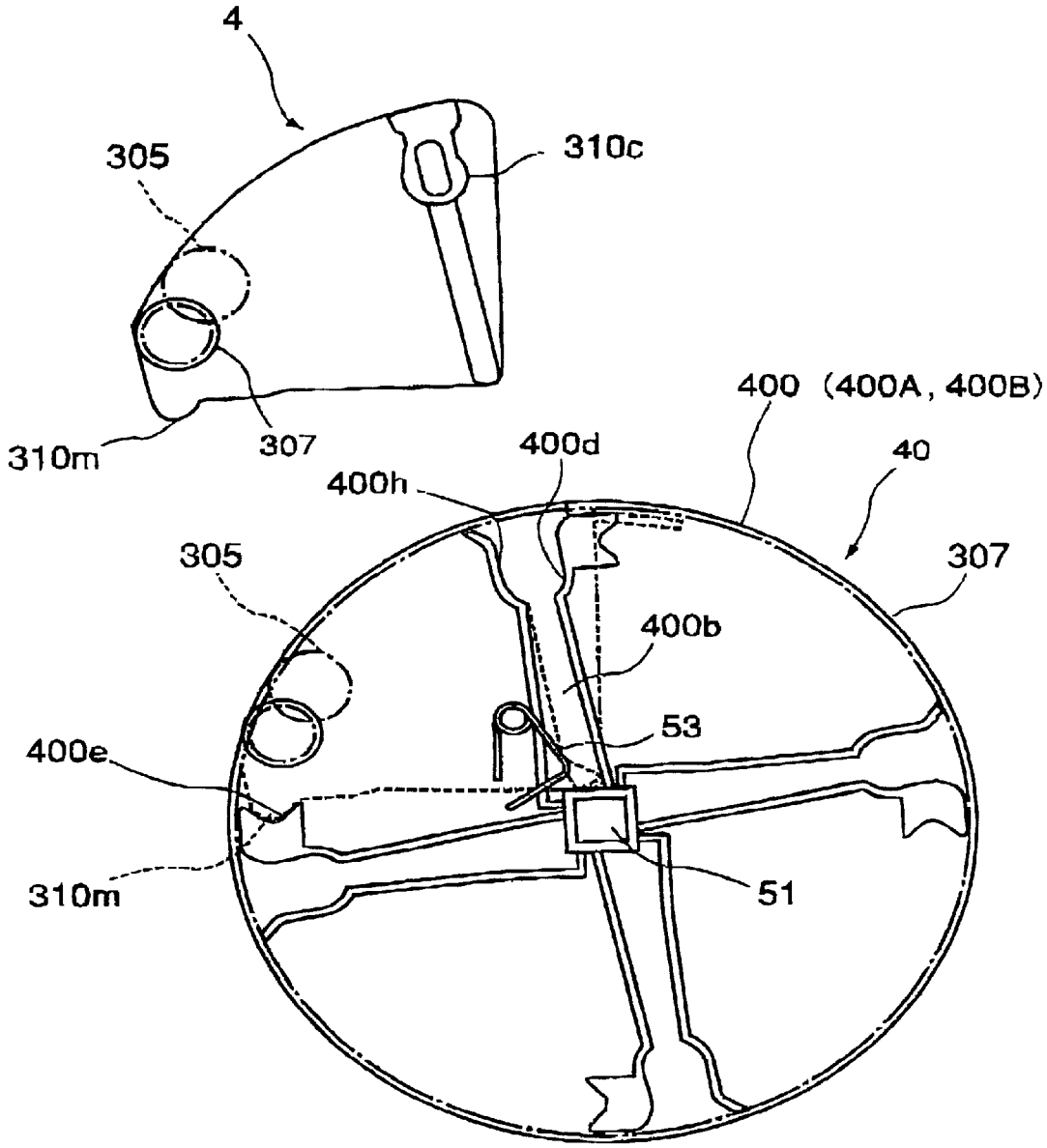
FIG. 13 illustrates a schematic view of an example of mounting of a developing cartridge onto the rotary disk.

Referring to FIGS. 11–13, the rotary 40 rotates about the central shaft 51, to the lengthwise ends of which a pair of rotary discs 400 (400A, 400B) is solidly fixed, one for one.

Each rotary disc 400 (400A, 400B) has four grooves, each of which comprises: a guiding portion 400*b* for guiding a development cartridge 4; a cartridge catching/guiding portion 400*h* which constitutes the portion for catching a development cartridge 4 by the lengthwise end; a positioning boss holding portion 400*d* which serves as a bearing as well as a development cartridge positioning portion, and about the axial line of which a development cartridge pivots; and a V-shaped development cartridge catching portion for locking a development cartridge 4 in a predetermined position in terms of its pivotal direction.

Figure 4:
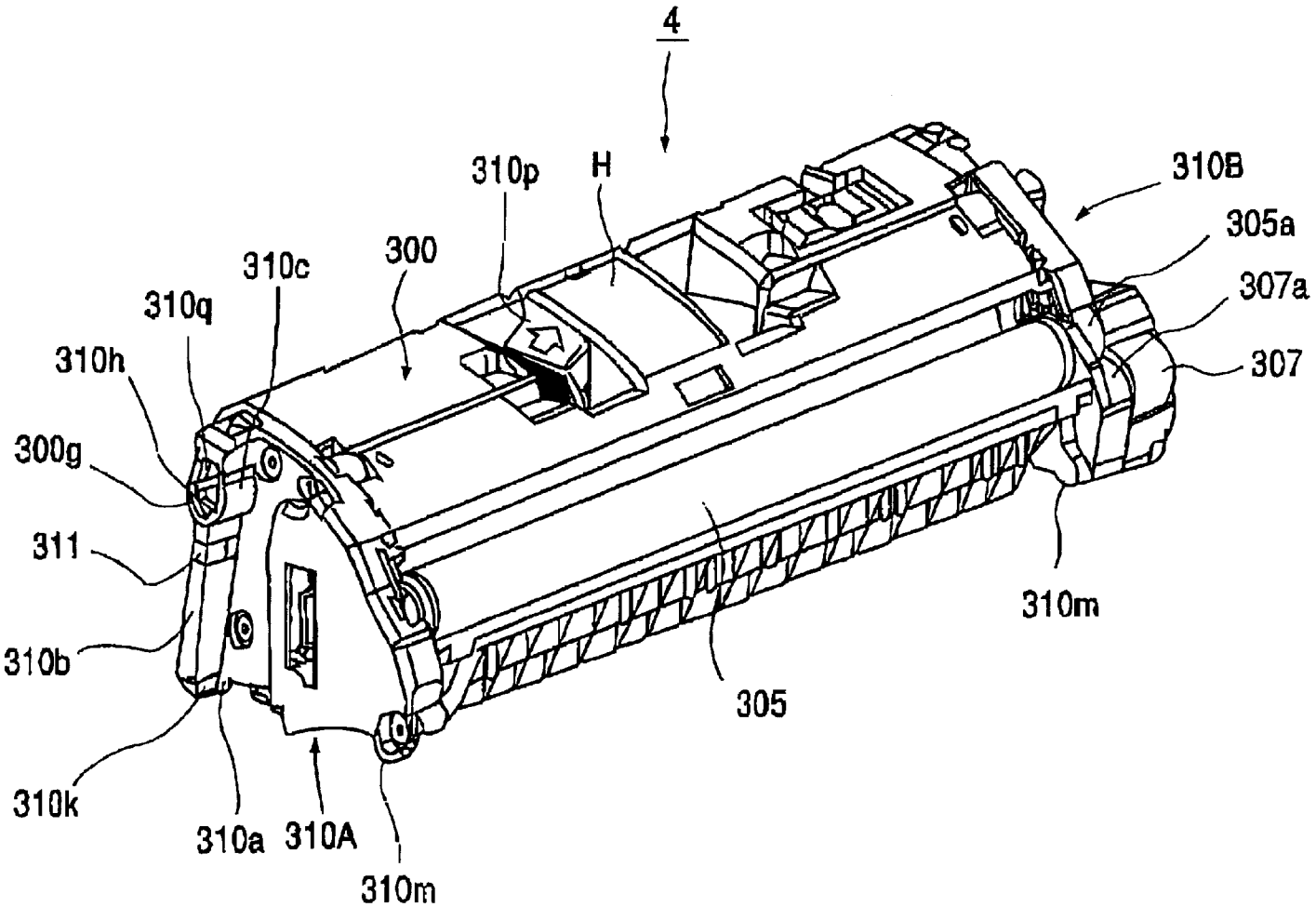
FIG. 4 is a perspective view of a developing cartridge according to Embodiment 1 of the present invention.
Figure 5:
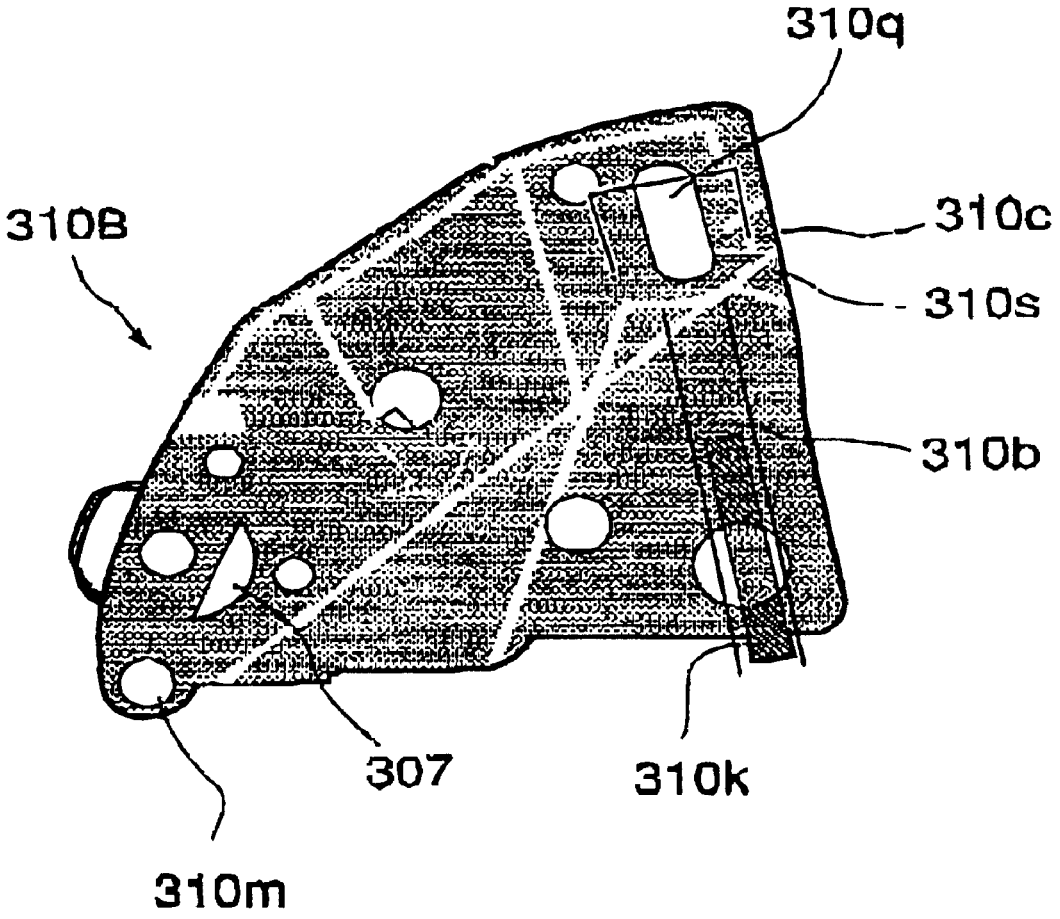
FIG. 5 is a side view at a driving side of a developing cartridge of FIG. 4.
Figure 6:
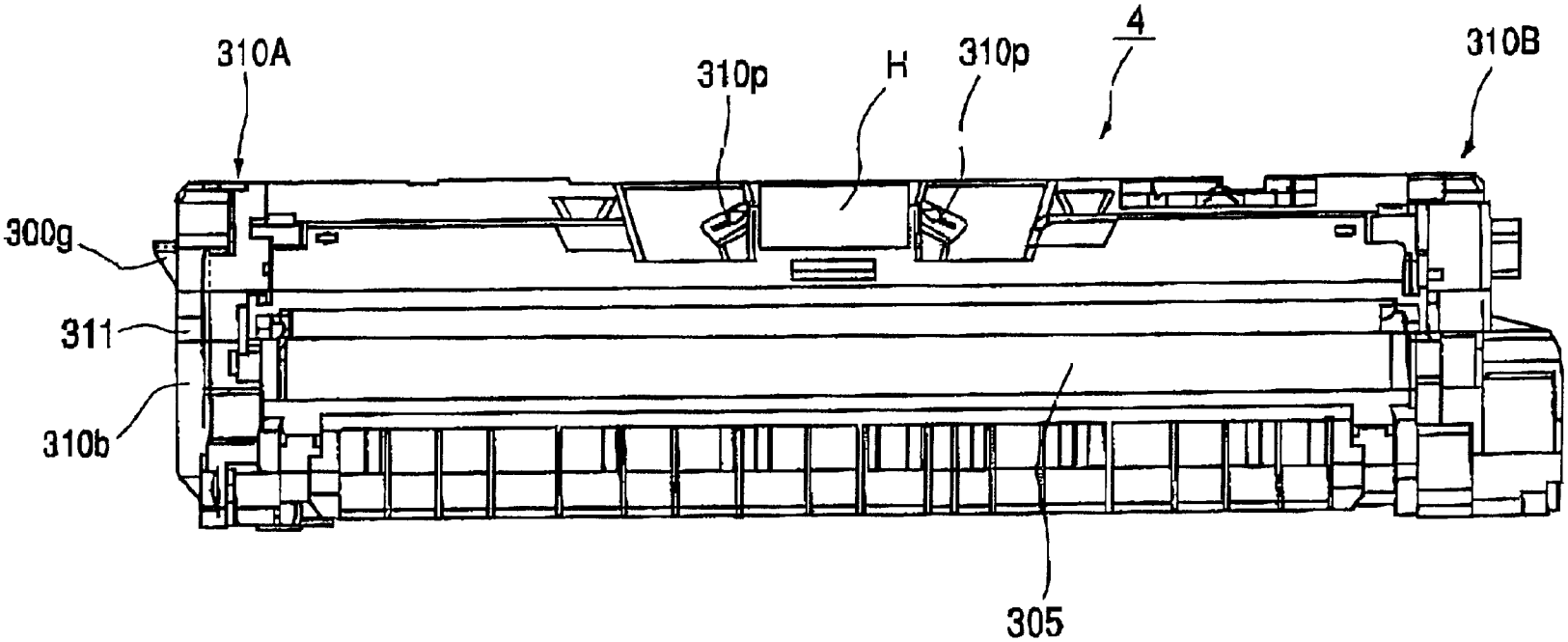
FIG. 6 is a front view of a developing cartridge of FIG. 4 as seen from a photosensitive drum side.

On the other hand, referring to FIGS. 4 and 5, the left and right end surfaces of each development cartridge 4 are provided with first and second guides, respectively, which perpendicularly protrude from the corresponding end surfaces. Each of the first and second guides has a cylindrical positioning boss 310*c*, the position of which corresponds to that of the development member 305 (development roller), and a flat guiding rib 310*b*. The boss 310*c* engages with the boss catching/guiding portion 400*h* and boss holding portion 400*d* of the groove of the rotary disc 400 (400A, 400B), whereas the guiding rib 310*b* fits in the guiding portion 400*b* of the groove of the rotary disc 400 (400A, 400B).

Further, the development cartridge 4 is provided with a projection 310*m* which fits in the projection catching portion 400*e* of the rotary disc 400 (400A, 400B), controlling the pivoting of the development cartridge 4, that is, locking the development cartridge 4 in a predetermined position in terms of its pivotal direction. To the guiding rib 310*b*, a development bias application electrode 311 A is attached. The contact point 311 of the development bias application electrode 311 A, which is electrically connected to the development bias application contact point 410 (FIG. 17) of the apparatus main assembly, is exposed at the lengthwise end surface of the development cartridge, more specifically, at least at the top surface of the guiding rib 310*b*, that is, the surface perpendicular to the lengthwise direction of the development cartridge.

Figure 20:
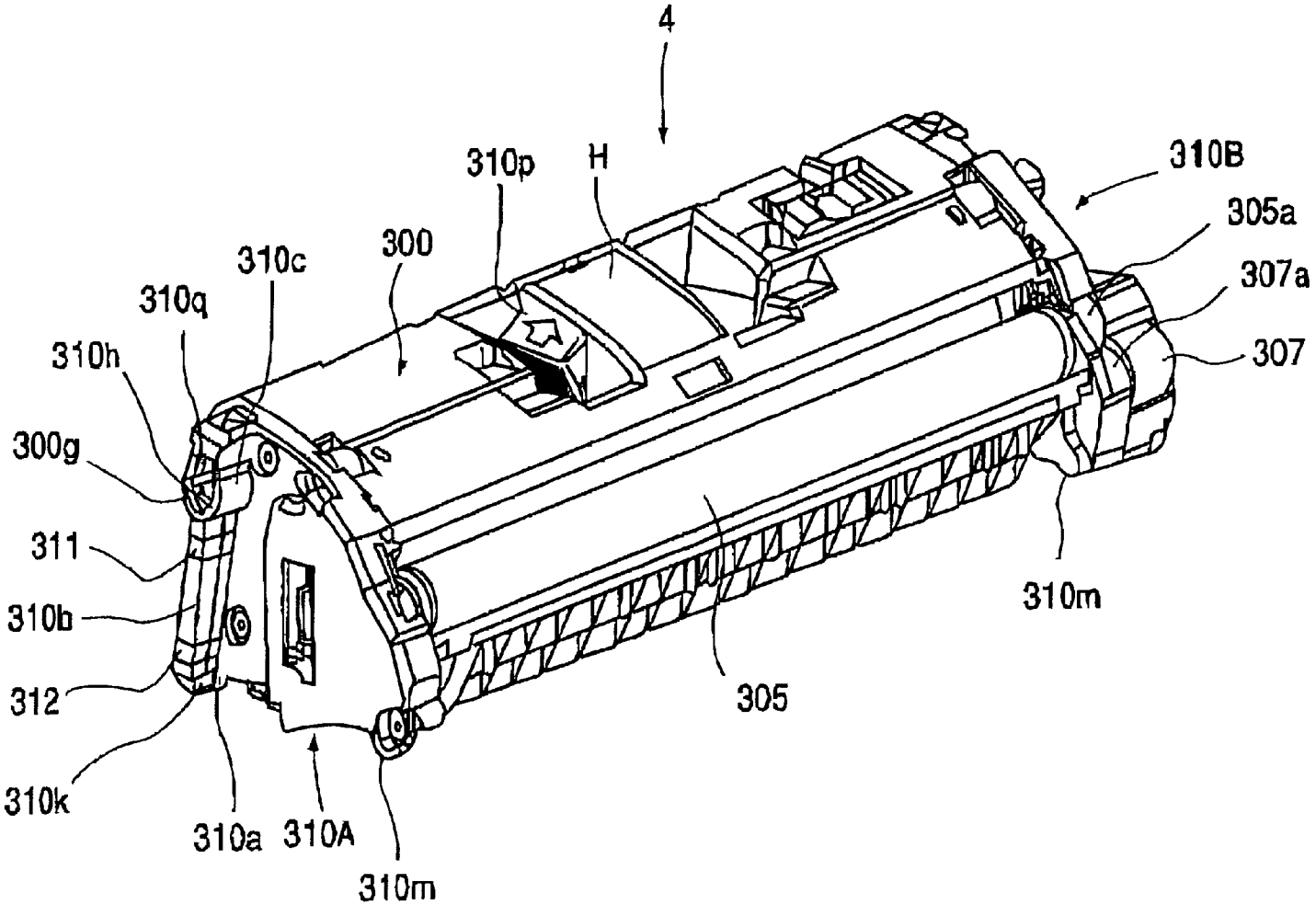
FIG. 20 is a perspective view of a developing cartridge according to Embodiment 2.
Figure 21:
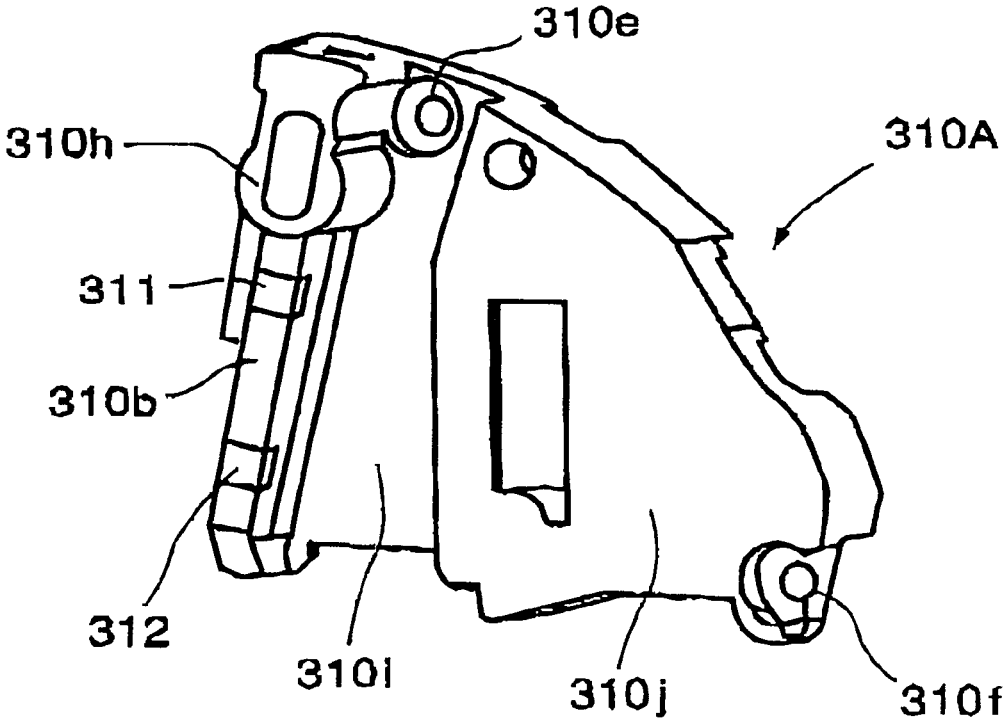
FIG. 21 is a perspective view illustrating a surface of a side cover of a developing cartridge.

Referring to FIG. 13, within the cartridge guiding portion 400*b* of the groove of the rotary disc 400 (400A, 400B), a spring 53 for keeping the development cartridge 4 pressured in the direction to rotate the development cartridge 4 in the counterclockwise direction of the drawing is provided. This spring 53 is in contact with a pressure catching portion 310*k* located below the guiding rib 310*b* (FIG. 20). The development cartridge 4 is kept pressured in the direction to rotate about the boss 310*c*, by the force generated by the resiliency of the spring 53, and the moment generated by the force applied to rotationally drive the development roller 305, as will be described later. As a result, the projection 310*m* of the development cartridge 4 is reliably kept in contact with the projection catching portion 400*e* of the rotary disc 400 (400A, 400B).

Figure 7:
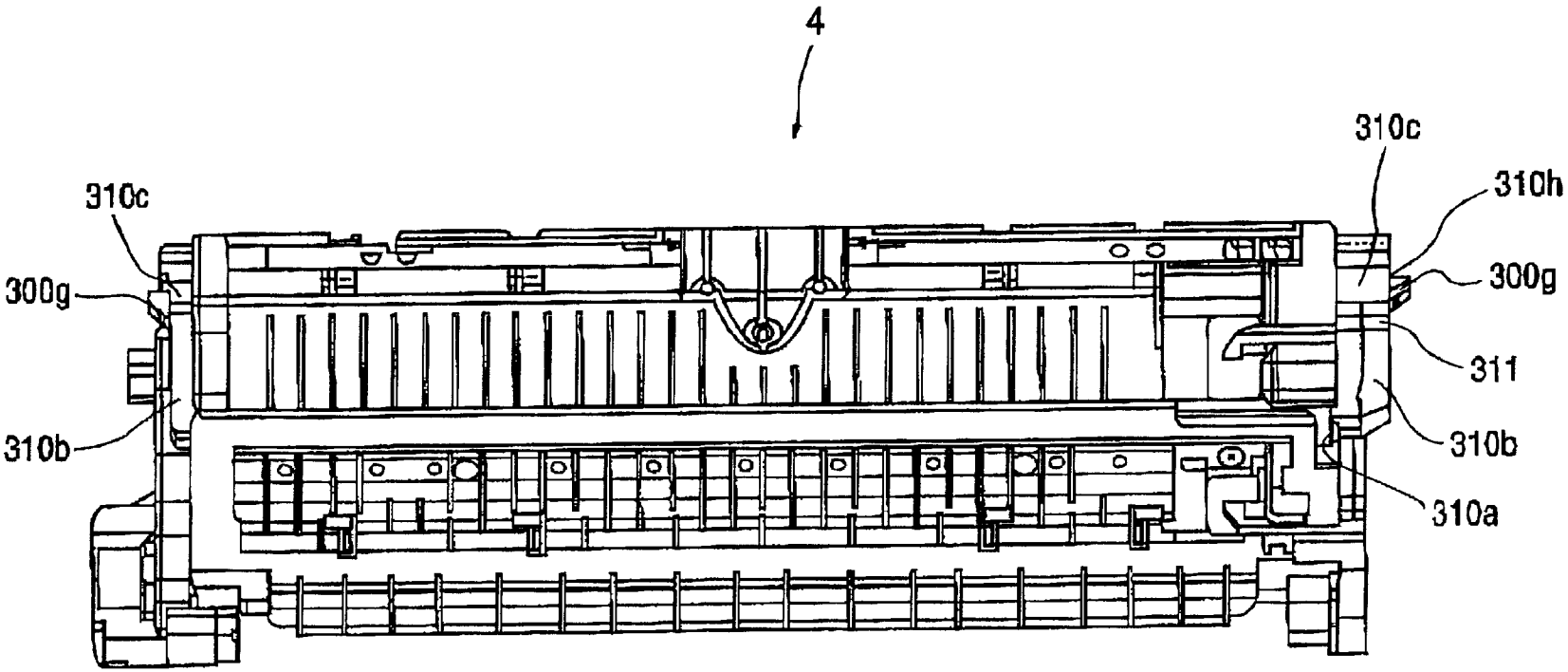
FIG. 7 is a bottom view of a developing cartridge of FIG. 4.
Figure 18:
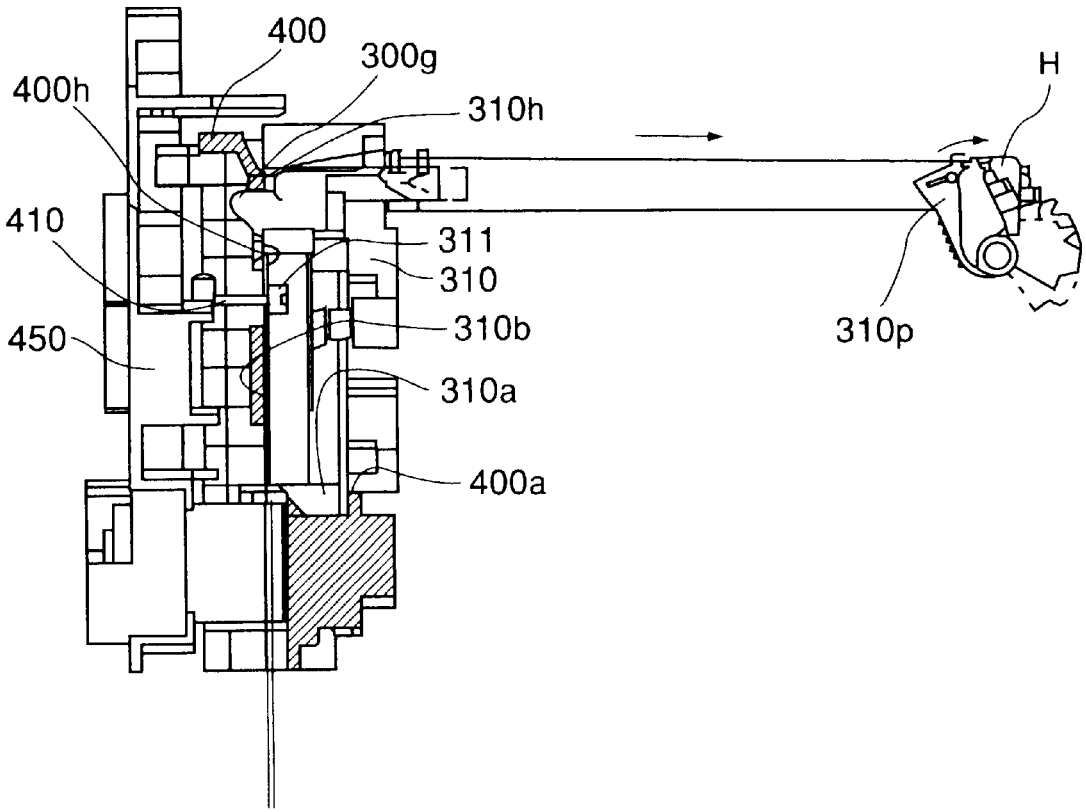
FIG. 18 is a partially sectional view showing details of a non-driving side rotary disk to illustrate a positioning in the longitudinal direction between the developing cartridge and the rotary disk and electric connection between the electrical contacts of the main assembly apparatus and the developing cartridge, according to Embodiment 1.

Further, referring to FIGS. 7, 11, 18, and the like, in this embodiment, the development cartridge 4 is provided with a locking portion 300*g* for preventing the development cartridge 4 from becoming dislodged. This locking portion 300*g* is enabled to move in the elongated through hole 310*q* in the positioning boss 310*c*, in the lengthwise direction of the development cartridge 4, being kept pressured in the outward direction of the development cartridge 4. The locking portion 300*g* retracts into the development cartridge 4 as a button 310*p* located on the handle H of the development cartridge 4 is pressed into the handle H.

Thus, when mounting the development cartridge 4 into the rotary 40, the locking portion 33*g* fits into the locking hole 400*g* in the cartridge catching/guiding portion 400*h* of the rotary disc 400 (400A, 400B), retaining the development cartridge 4 locked in the rotary.

With the provision of this locking mechanism, the development cartridge 4 does not become separated from the rotary 40 when the rotary 40 is rotated. All that is necessary to remove the development cartridge 4 from the apparatus main assembly is to push the button 310*p* into the handle H while holding the handle H located at the center of the top surface of the development cartridge 4. With the button 310*p* kept pressed into the handle H, the development cartridge 4 can be pulled out, upward from the rotary 40 as shown in FIG. 11.

As described above, the development cartridge 4 is removably held by the left and right rotary discs 400 (400A, 400B) of the rotary 40, which are provided with the spring 53, locking portion 33*g*, and the like; in other words, the development cartridge 4 is enabled to be mounted into, or dismounted from, the apparatus main assembly, more specifically, the rotary 40, by a user.

(Structures of Driving Rotary and Development Cartridge)

Next, referring to FIGS. 14–17, the structural arrangement for driving the rotary 40 and development cartridge 4 will be described. To each lengthwise end of the rotary 40, a rotary supporting plate 450 is attached, and the center shaft 51 is put through the rotary disc 400 and rotary disc supporting plate 450; in other words, the rotary disc 400 and center shaft 51 are rotationally supported by the rotary supporting plate 450.

Figure 14:
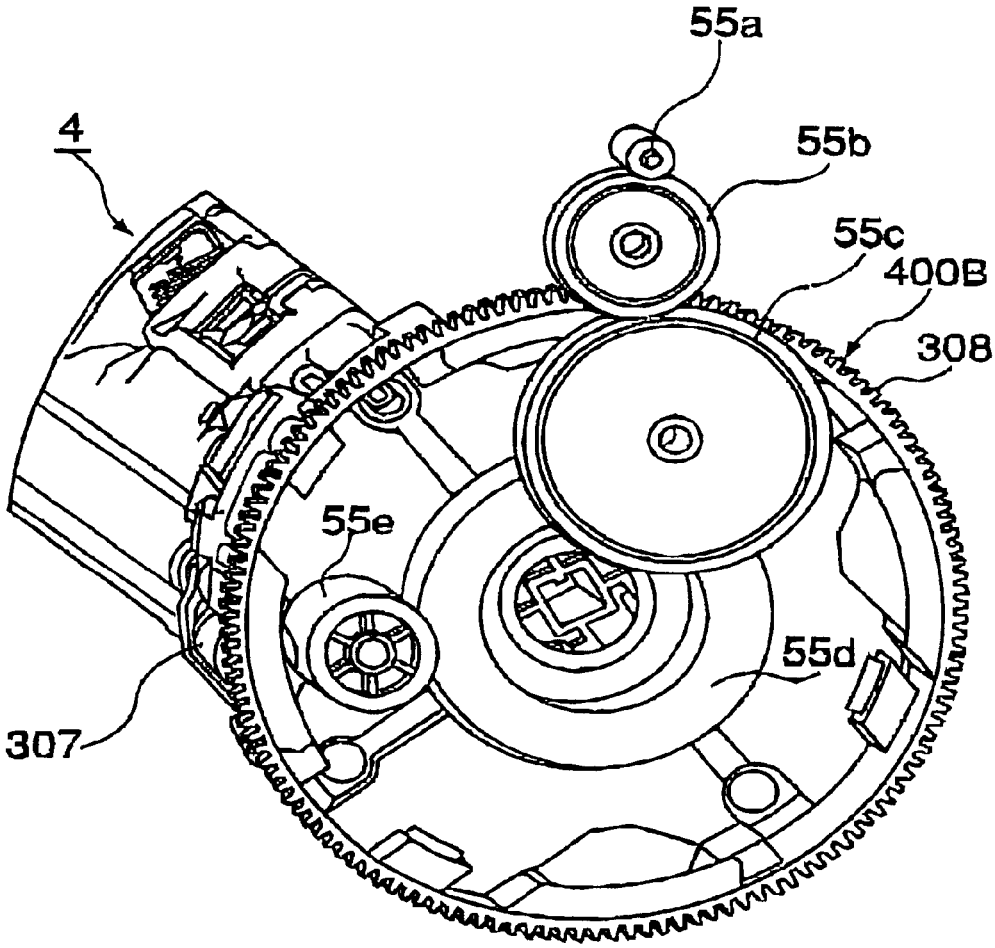
FIG. 14 illustrates a schematic view of a gear drive transmission for driving a developing cartridge.

Referring to FIGS. 11 and 14, the peripheral portion of each of the rotary discs 400 (400A, 400B) constitutes a gear 308, which is an integrally formed part of the rotary disc. Although not illustrated, this gear 308 is meshed with a follower gear located at each lengthwise end of the rotary 40. The two follower gears, one at each lengthwise end of the rotary 40, are connected with a rotational shaft so that as one of the rotary discs 400, for example, disc 400A rotates, the other, or disc 400B, will also rotate in the same phase. Further, to the gear 308 of one of the rotary discs 400, which in this embodiment is the gear 308 of the rotary disc 400B, a rotary driving motor (unillustrated) is connected.

With the provision of the above described driving mechanism, it is prevented that one of the rotary discs 400 (400A, 400B) becomes twisted when the rotary discs (400A, 400B) are rotated, or when the development roller is driven.

Figure 16:
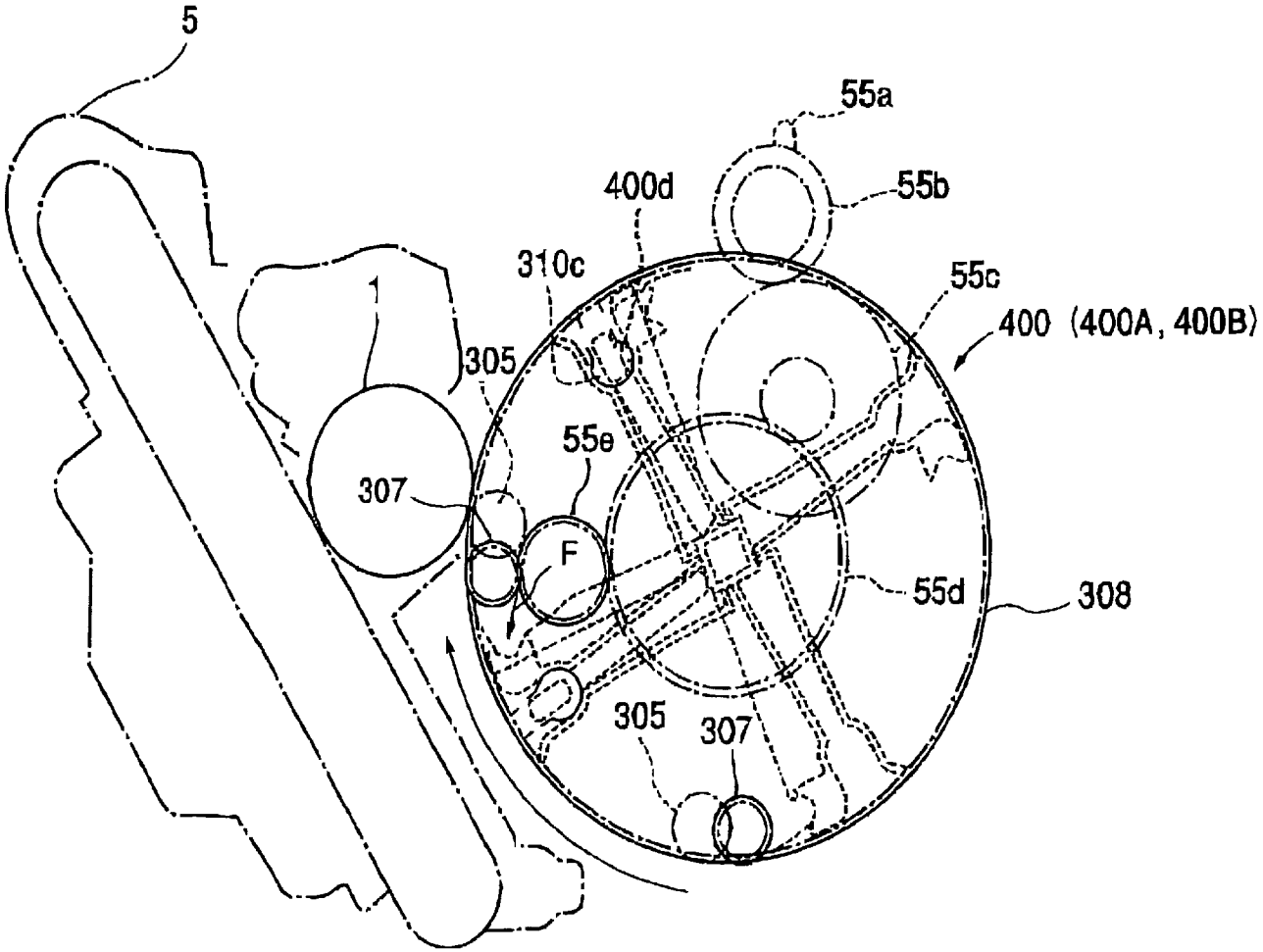
FIG. 16 illustrates an example of engagement of a gear for driving a developing cartridge situated at a development position.

One of the rotary supporting plates 450, which in this embodiment is the rotary supporting plate 450 on the rotary disc 400B side, is provided with a plurality of gears 55 (55*a*, 55*b*, 55*c*, 55*d*, and 55*e*), as shown in FIGS. 14 and 16. The driving force input gear 308 of the development cartridge 4 meshes with the gear 55*e*, or the most downstream gear of the plurality of the gears 55 (driving force transmission gear train) attached to the rotary supporting plate 450, and drives the development roller 305, coating roller 304, stirring member 303, and the like.

In this embodiment, the driving force input gear 307 is engaged with the end gear 55*e* of the rotary supporting plate 450, as the development cartridge 4 is orbitally moved a predetermined angle by the rotation of the rotary discs 400.

Figure 15:
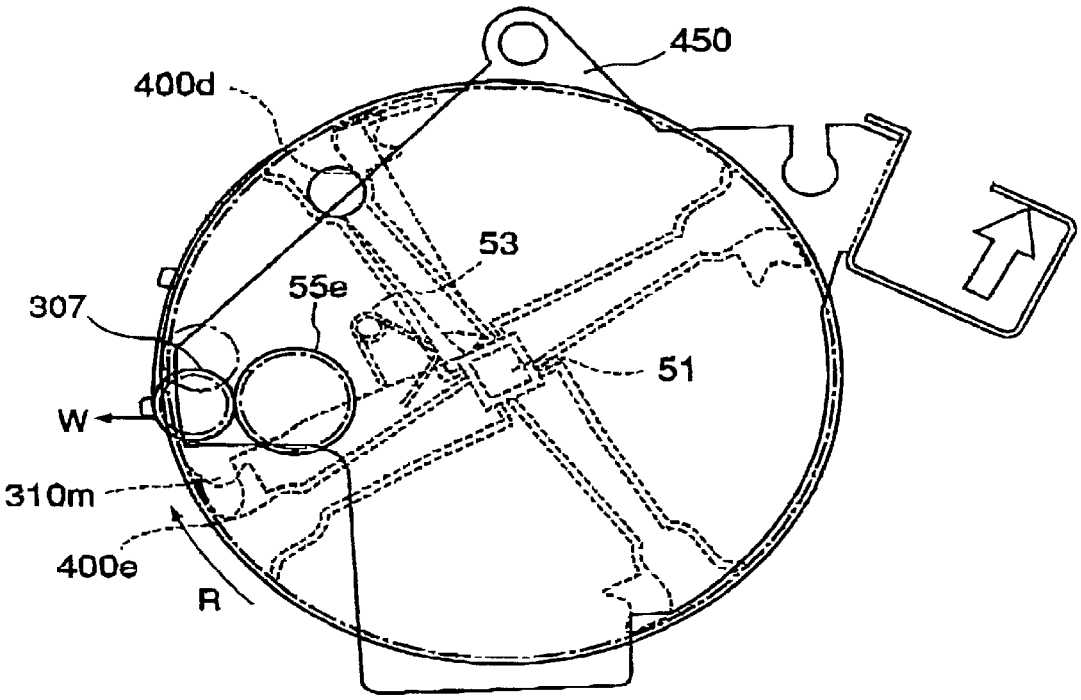
FIG. 15 illustrates a schematic view of an engagement between a gear for driving a developing cartridge and a developing cartridge moving to a development position.

Here, referring to FIG. 15, the end gear 55*e* attached to the rotary supporting plate 450 meshes with the driving force input gear 307 of the development cartridge 4, as the development cartridge 4 is orbitally moved to the development position, in the direction indicated by an arrow mark R, by the rotation of the rotary 40.

As the driving force input gear 307 of the development cartridge 4 receives the driving force from the end gear 55*e* of the rotary supporting plate 450, it is subjected to a force F generated by the meshing between the driving force input gear 307 and end gear 55*e* in the direction indicated by an arrow mark in FIG. 16. As a result, the development cartridge 4 is subjected to such counterclockwise moment that acts in the direction to rotate the development cartridge 4 about the positioning boss 310*c* of the development cartridge 4 held in the boss holding portion 400*d* of the groove of the rotary disc 400. With the development cartridge 4 being subjected to this rotational moment, the projection 310*m* of the development cartridge 4 is kept pressed in the V shaped projection catching recess 400*e* of the rotary disc 400, preventing the development cartridge 4 from becoming dislodged from the predetermined position in the rotary 40. Incidentally, this force F from the meshing between the driving force input gear 307 and end gear 55*e* constitutes a part of a closed system confined within the rotary, affecting very little the pressure W (FIG. 15) applied to the photoconductive drum 1 by the development cartridge 4.

The above description of the positioning of a development cartridge relative to a rotary disc 400 (400A, 400B) applies to both rotary discs 400A and 400B.

In this embodiment, however, the structure of the rotary disc 400B is made different from that of the rotary disc 400A.

That is, in this embodiment, the size (more specifically, diameter) of the positioning boss 310*c* of the development cartridge 4, on the rotary disc 400B side, is made smaller than the positioning boss holding portion 400*d* of the groove of the rotary disc 400B, as shown in FIG. 5, providing a play between the two. Further, the positioning boss 310*c* is provided with a rib 310*s* which engages in the boss holding portion 400*d*.

With the provision of the above described structural arrangement, on the rotary disc 400A side, the positioning boss 310*c* of the development cartridge 4 perfectly fits in the positioning boss holding portion 400*d* of the rotary disc 400A, and the projection 310*m* of the development cartridge 4 fits in the V-shaped projection catching recess 400*e* of the rotary disc 400A, positioning the development cartridge 4 with a high degree of precision.

In comparison, on the rotary disc 400B side, the positioning boss 310*c* of the development cartridge 4 loosely fits in the positioning boss holding portion 400*d* of the rotary disc 400B. However, as the driving force begins to be transmitted to the development cartridge 4 by the movement of the development cartridge 4 to the development position, the development cartridge 4 is pressed in the direction indicated by an arrow mark. As a result, the projection 310*m* of the development cartridge 4 fits into the V-shaped projection catching recess 400*e* of the rotary disc 400A. Further, the rib 310*s*, which is a part of the positioning boss 310*c*, fits into the boss holding portion 400*d*. Therefore, the development cartridge 4 is accurately placed in a predetermined position.

Also in this embodiment, the development cartridge 4 is accurately positioned relative to the rotary 40, and therefore, relative to the apparatus main assembly, by being moved to the development position.

(Method for Mounting Development Cartridge into Image Forming Apparatus)

Described next will be the structures of the guiding rib 310*b* and development bias application contact point of the development cartridge 4, which characterize the present invention.

Figure 8:
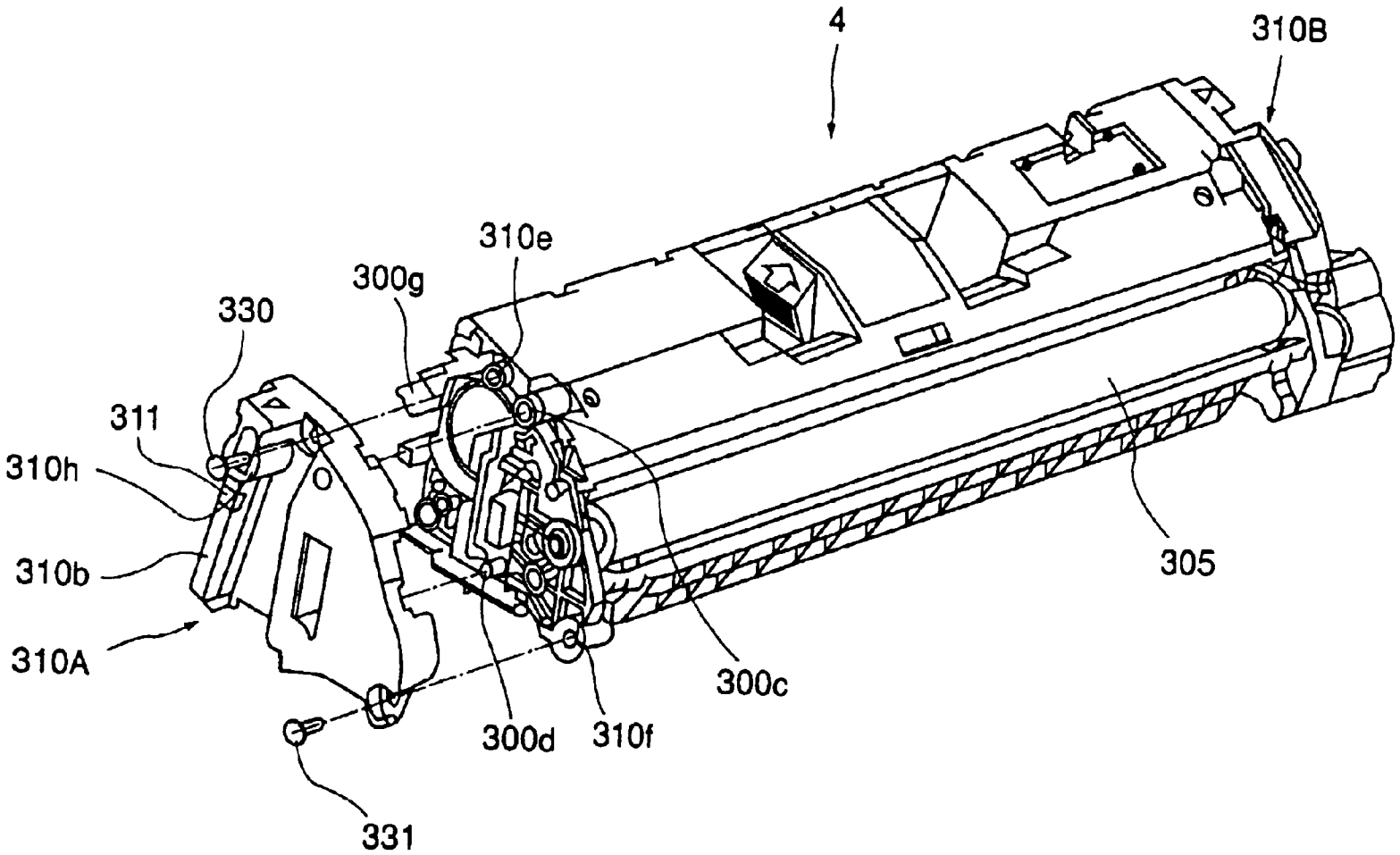
FIG. 8 is a perspective view illustrating mounting of a side cover in the developing cartridge of FIG. 4.

Referring to FIGS. 4–10, in this embodiment, the end surface of the development cartridge 4, at each lengthwise end of the development cartridge 4, is the outwardly facing surface of a side cover 310 (310A, 310B) separable from the main assembly of the development cartridge 4. FIG. 8 shows the development cartridge 4, the side cover 310A of which, that is, the side cover on the left side, has been separated from the development cartridge main assembly.

Figure 9:
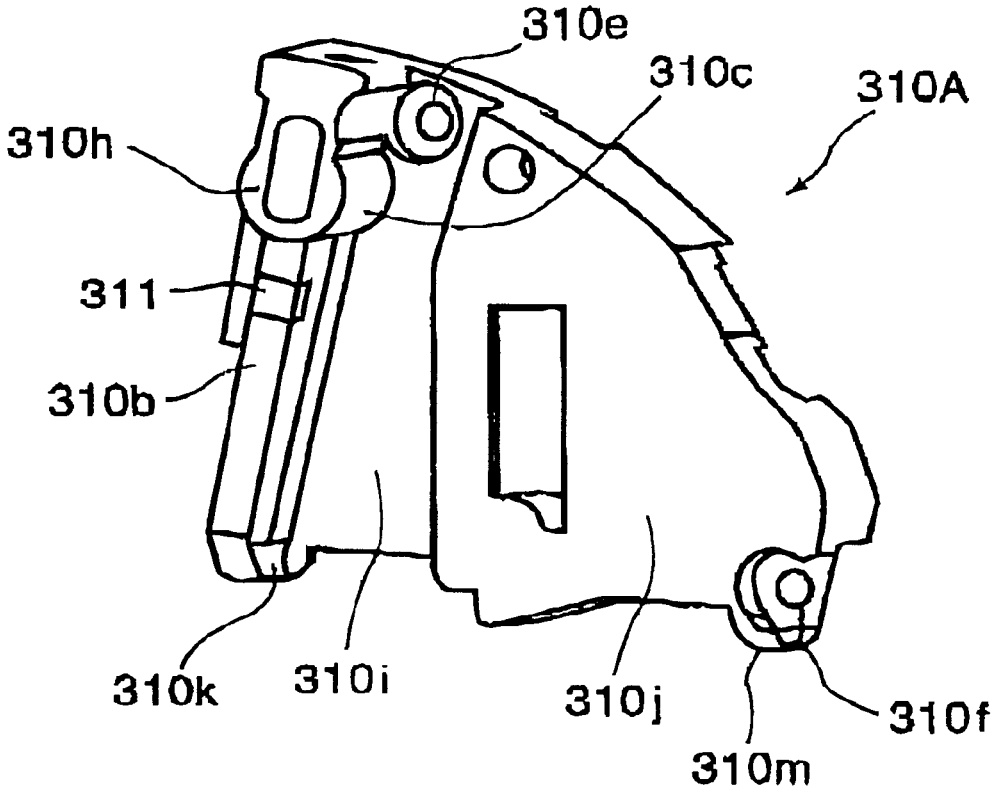
FIG. 9 is a perspective view illustrating a surface of a side cover of a developing cartridge.
Figure 10:
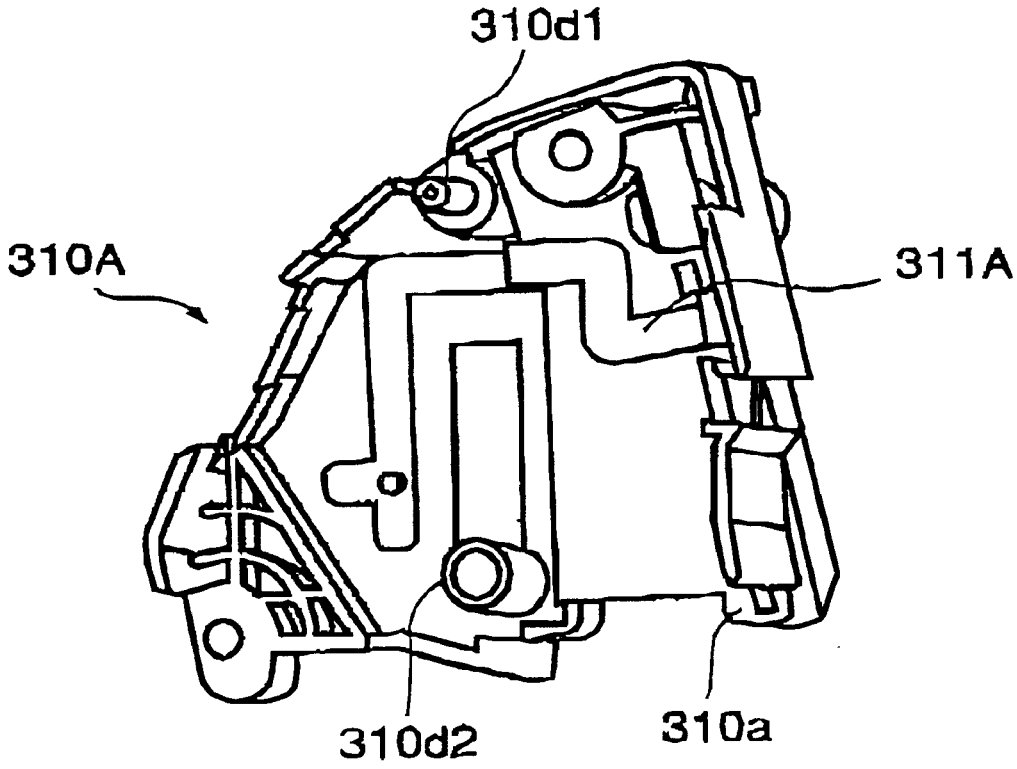
FIG. 10 is a perspective view illustrating a back side of a side cover of the developing cartridge of FIG. 4.

Referring to FIGS. 8–10, the side cover 310A is attached to the development cartridge main assembly by aligning the positioning hole 300*c* and boss 300*d* of the development cartridge main assembly with the positioning boss 310*d*1 and elongated hole 310*d*2 of the side cover 310, respectively, putting screws 330 and 331 through the holes 310*e* and 310*f* of the side cover 310A, and then, screwing the screws 330 and 331 into the development cartridge main assembly. As for the side cover 310B, it is also attached to the development cartridge main assembly with screws, in the same manner as the side cover 310A.

As described above, in the case of the development cartridge 4 in this embodiment, the side covers 310 (310A, 310B) attached to the lengthwise ends of the development cartridge main assembly are each provided with the positioning boss 310*c* for positioning the development cartridge 4, and the guiding rib 310*b* for guiding the development cartridge 4. The development cartridge 4 is placed in a predetermined relationship to the rotary disc 400 (400A, 400B), in other words, relative to the image forming apparatus main assembly, as the positioning boss 310*c* and guiding rib 310*b* are engaged into the positioning boss catching portion 400*h*, positioning boss holding portion 400*d*, cartridge guiding portion 400*b*, and the like, of the groove of the rotary disc 400 (400A, 400B).

On the side cover 310A side of the development cartridge 4, the development bias application electrode 311A is provided, with the development bias application contact point 311 exposed at the top surface of the guiding rib 310*b*, that is, the surface perpendicular to the lengthwise direction of the development cartridge 4. The development bias application contact point 311, which will be described later in detail, becomes electrically connected to the development bias application contact point 410 (FIG. 19), as the development cartridge 4, is moved into in the development position.

Referring to FIG. 10, in this embodiment, the development bias application electrode 311A comprising the development bias application contact point 311 is configured so that as the side cover 310A is attached to the development cartridge main assembly; it is electrically connected to the developing member 305 (development roller) and developer coating member 304 (toner supply roller) of the development cartridge 4, as shown in FIG. 10, making it possible to apply development bias and coating member bias to the development roller 305 and toner supply roller 304, respectively.

Since the development bias contact point 311 is exposed at the guiding rib 310*b*, the contact point is placed straight into the rotary 40, in other words, the apparatus main assembly, as the development cartridge 4 is inserted into the rotary 40. Further, the guiding rib 310*b* is such a portion of the development cartridge 4 that fits into the cartridge guiding portion 400*b* of the groove of the rotary disc 400 to guide the development cartridge 4, and the contact point 311 is exposed at the guiding rib 310*b*. Therefore, the contact point 311 is guided by the cartridge guiding portion 400*b* of the groove as the guiding rib 310*b* is guided by the cartridge guiding portion 400*b* of the groove, assuring that the contact point 311 is set so that development bias can be applied to the development cartridge 4 from the image forming apparatus main assembly through the contact point 311.

Further, referring to FIGS. 4 and 18, the development cartridge 4 has a first projection 310*h*, which is placed in contact with the development bias application electrode portion of the image forming apparatus main assembly to position the main assembly of the development cartridge in terms of its lengthwise direction, and a second projection 310*a* for regulating the movement of the development cartridge 4 in the direction opposite to the direction in which the development cartridge 4 is moved so that the first projection 310*h* is placed in contact with the development bias application electrode portion of the image forming apparatus main assembly. This structural arrangement and its function will be described more later.

Next, referring to FIGS. 11 and 12, the rotary 40 and rotary disc 400 (400A, 400B) will be further described.

FIG. 11 shows how the development cartridge 4 is inserted into the rotary 40, and FIG. 12 shows the details of the rotary disc 400A, or the rotary disc 400 on the side from which the rotary is not driven.

Referring to FIG. 12, the rotary disc 400A on the non-driven side is provided four grooves, each of which comprises: a portion 400*h* for placing the development cartridge 4 in contact with the development bias contact point 410 portion of the apparatus main assembly; a positioning boss holding portion 400*d* for holding the positioning boss 310*c* of the development cartridge 4; a regulating portion 400*a* for regulating the movement of the development cartridge 4 in the direction opposite to the direction in which the development cartridge 4 is moved so that the first projection 310*h* is placed in contact with the development bias application electrode portion of the image forming apparatus main assembly; a cartridge guiding portion 400*b*; a hole 400*c* for allowing the development bias application contact point 410 on the apparatus main assembly side to be placed in contact with the development cartridge 4; and a locking hole 400*g* into which the locking portion 300*g* of the development cartridge 4 is placed.

Referring to FIG. 11, the development cartridge 4 is to be inserted in the rotary 40, with the guiding portion 310*b* on each end surface of the development cartridge 4 aligned with the corresponding guiding portion 400*b* of the groove of the rotary 40. After the insertion, the rotary 40 is to be rotated so that the development cartridge 4 is moved to a position at which the contact point 410, shown in FIG. 17, attached to the supporting plate 450 of the rotary 40 contacts the development cartridge 4.

FIG. 15 shows the state of the rotary 40, in which one of the development cartridges 4 is at the predetermined position, that is, the development position, being locked therein.

Figure 19:
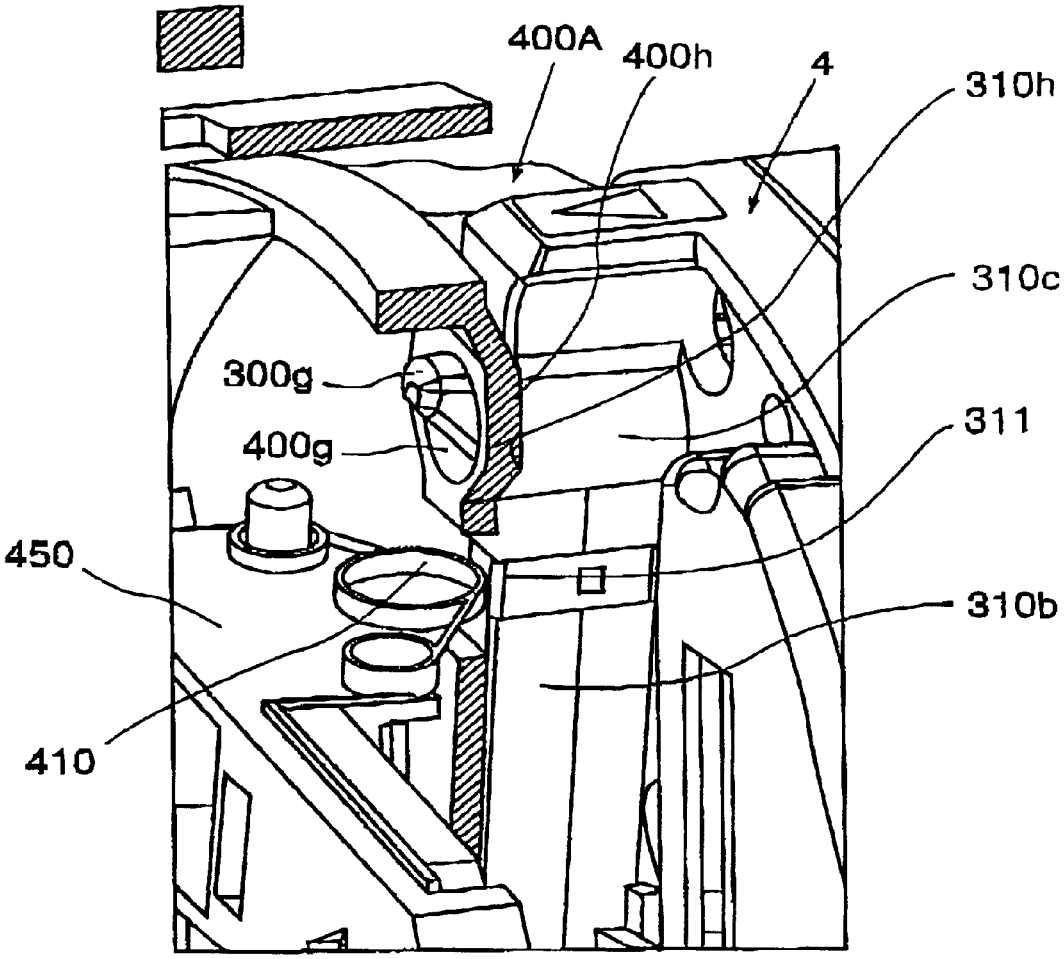
FIG. 19 is a partial perspective view of details of non-driving side rotary disk to illustrate a positioning in the longitudinal direction between the developing cartridge and the electric connection between the electrical contacts of the main assembly apparatus and the developing cartndge, according to Embodiment 1.

In this state, the first projection 310*h* of the development cartridge 4 has come into contact with the cartridge catching portion 400*h* of the rotary 40, as shown in FIGS. 18 and 19, fixing the distance between the development bias application contact 410 of the apparatus main assembly and development cartridge 4.

In other words, as the development cartridge 4 is moved to the development position, the driving gear 55*c* on the apparatus main assembly side is meshed with the driving force input gear 307 of the development cartridge 4 as shown in FIG. 14. As a result, the driving force is transmitted from the driving force input gear 307 to the development roller driving gear 305*a* through an idler gear 307*a* integral with the driving force input gear 307, as shown in FIG. 4.

In this embodiment, the driving force input gear 307, idler gear 307*a*, and development roller driving gear 305*a* are helical gears, and are structured and arranged so that as the driving force input gear 307 is driven, force is applied to the development roller 305 and development cartridge 4 in the leftward direction, that is, the leftward direction in FIGS. 4 and 11 in terms of the lengthwise direction of the development hcartridge 4. Therefore, as the driving force input gear 307 is driven, the first projection 310*h* of the development cartridge 4 comes into contact with the cartridge catching portion 400*h* of the rotary 40 as shown in FIG. 19.

On the other hand, the lengthwise movement of the development cartridge 4 in the opposite direction (rightward direction in FIGS. 4 and 11) is regulated by the contact between the end surface of the second projection 310*a* attached to the development cartridge 4 and the end surface of the regulating portion 400*a* of the groove of the rotary disc 400 of the image forming apparatus main assembly, as shown in FIG. 18.

In other words, not only is the development cartridge 4 provided with the first projection 310*h* for regulating the aforementioned leftward movement of the development cartridge 4, but also the second projection 310*a* for regulating the movement of the development cartridge 4 in the opposite direction, or the rightward direction. Therefore, even when the projection 310*h* of the development cartridge 4 fails to remain in contact with the cartridge catching portion 400*h* of the rotary 40 due to the fluctuation in the driving force, driving condition, and/or the like, the change in the distance between the development bias application contact point 410 of the image forming apparatus main assembly and the development bias application contact point 311 of the development cartridge 4 is minimized.

Figure 17:
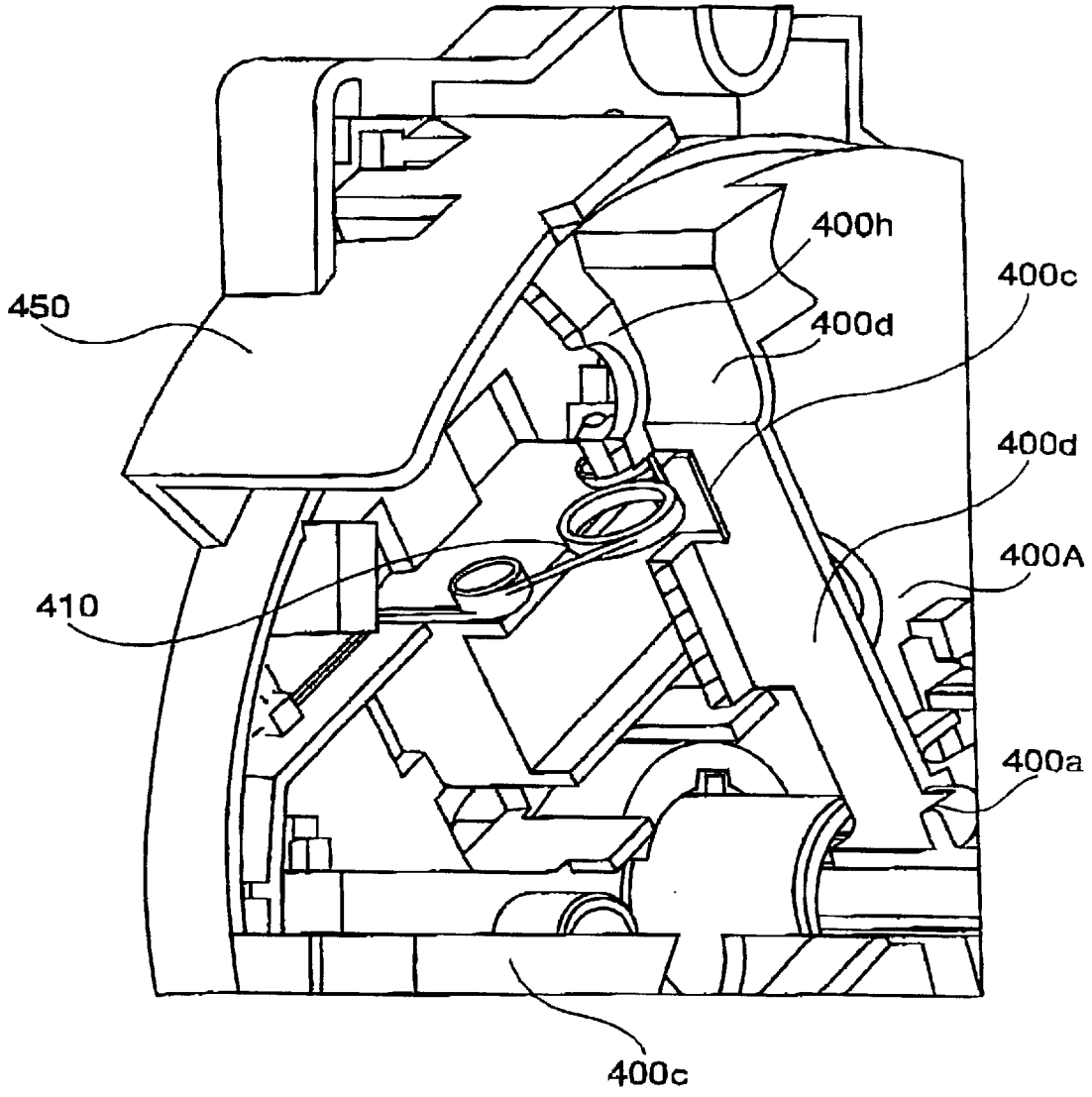
FIG. 17 is a perspective view showing a detail of a rotary disk at a non-driving side for illustrating connection between the electric contacts of the developing cartridge and the main assembly apparatus according to Embodiment 1.

To describe in more detail, the development bias application contact point 410 of the image forming apparatus main assembly in this embodiment is in the form of a coil spring, and is attached to the supporting plate 450 of the rotary 40 as shown in FIGS. 17 and 19. As the development cartridge 4 is moved to the predetermined position, the development bias application contact point 311 of the development cartridge 4 comes into contact with the development bias application contact point 410 of the image forming apparatus main assembly.

The development bias application contact point 311 of the development cartridge 4 is attached to the guiding rib 310*b* on the non-driven side, and the first positioning projection 310*h*, boss 310*c*, and guiding rib 310*b* are integral parts of a single component. The amount of the fluctuation of the distance between the first projection 310*h* for positioning the development cartridge 4 in terms of the lengthwise direction of the development cartridge 4, and the development bias application contact point 311, remains within the range of the positional deviation of the single component traceable to the tolerance of the component.

Further, as for the positional relationship between the development bias application contact point 410 of the image forming apparatus main assembly and the development bias application contact point 311 of the development cartridge 4, the two development bias application contact points 410 and 311 are connected to each other, through the hole 400*c* of the rotary disk 400 of the rotary 40.

Therefore, the positional relationship between the development bias application contact point 410 of the image forming apparatus main assembly and the development bias application contact point 311 of the development cartridge 4 is determined by a smaller number of components, minimizing the amount of the error resulting from the addition of the tolerances of a plurality of components. In other words, the above described structural arrangement minimizes the alteration in the positional relationship between the two development bias application contact points 410 and 311, ensuring that the development bias is reliably applied.

Further, not only is the rotary disc 400A on the non-driven side, that is, the side which is distant from the driving force input portion provided with the driving force input gear 307, used to fix the position of the development cartridge 4 relative to the rotary 40, or the image forming apparatus main assembly, in terms of the lengthwise direction of the development cartridge 4, but also it is used to apply the development bias. Therefore, the positional relationship between the development bias application contact point 410 of the image forming apparatus main assembly and the development bias application contact point 311 of the development cartridge 4 is not likely to be affected by the positional deviation of the development cartridge 4 in the widthwise direction (direction perpendicular to lengthwise direction) of the development cartridge 4; in other words, the positions of the development bias application contact point 410 of the image forming apparatus main assembly and development bias application contact point 311 of the development cartridge 4 are likely to be kept stable, ensuring that the development bias is reliably applied.

Next, referring to FIG. 9, the electrophotographic image forming apparatus equipped with the rotary developing apparatus 4A is structured so that the contact point 311 is attached to the guiding rib 310*b*, the top surface of which is located higher than surfaces 310*i* and 310*j*, and also that during the rotation of the rotary 40, the resin portion of the development cartridge 4 will neither enter the path of the development bias application contact point 311 of the development cartridge 4, nor be at the same height as the development bias application contact point 311. Therefore, the bias voltage can be applied without damaging the resin portion of the development cartridge 4. Further, referring to FIG. 18, the end surface of the guiding rib 310*b* is recessed a distance in the inward direction of the development cartridge 4, from the end surface of the projection 310*h* for regulating the development cartridge 4 in terms of the lengthwise direction of the development cartridge 4.

Further, only the predetermined surface of the guiding rib 310*b* needs to be provided with a raised portion to which the development bias application contact point 311 is attached; neither surface 310*i* nor 310*j* needs to be provided with a raised portion to which the development bias application contact point 311 is attached, improving spacial efficiency. In other words, the surfaces 310*i* and 310*j* do not have a portion which makes the development cartridge 4 hang up when inserting the development cartridge 4, allowing the development cartridge 4 to be smoothly inserted, improving therefore the efficiency with which the development cartridge 4 is mounted or dismounted by a user.

As described above, in this embodiment, the development cartridge 4 is provided with the first projection 310*h* for positioning the development cartridge 4 relative to the rotary 40 in terms of the lengthwise direction of the development cartridge 4, and the second projection 310*a* for regulating the movement of the development cartridge 4 in the direction opposite to the first projection 310*h*, whereas the rotary 40 of the image forming apparatus main assembly is provided with the cartridge catching portion 400*h* and the regulating portion 400*a* for regulating the movement of the development cartridge 4 in the direction to move away from the cartridge catching portion 400*h*. Therefore, the distance between the development bias application contact point 410 of the apparatus main assembly and the development bias application contact point 311 of the development cartridge 4 is kept virtually constant, ensuring that the development bias is reliably applied.

Further, not only is the position of the development cartridge 4 in terms of its lengthwise direction fixed by the rotary disc 400A, that is, the rotary disc 400 on the non-driven side of the development cartridge 4, which is distant from the driving force input portion, but also the development bias is applied through the rotary disc 400A. Therefore, the positional relationship between the development bias application contact 410 of the image forming apparatus main assembly and the development bias application contact point 311 of the development cartridge 4 is unlikely to be affected by the positional deviation of the development cartridge 4 in terms of its widthwise direction, ensuring that the development bias is reliably applied.

Further, the development bias application contact point 311 on the development cartridge side is attached to the guiding rib 310*b* of the development cartridge 4, preventing the resin portion of the development cartridge 4 adjacent to the development bias application contact point 311 from being damaged during the rotation of the rotary 40. Therefore, it is unnecessary for the development bias application contact point 311 to be raised relative to the surfaces 310*i* and 310*j* of the development cartridge 4; in other words, only the guiding rib 310*b* needs to be provided with a raised portion to which the development bias application contact point 311 is attached, contributing to the improvement in spacial efficiency. Further, the absence of the raised portions on the surfaces 310*i* and 310*j* means that the surfaces 310*i* and 310*j* do not have a portion which causes the development cartridge 4 to hang up during the insertion of the development cartridge 4, allowing the development cartridge 4 to be smoothly inserted, improving therefore the efficiency with which the development cartridge 4 can mounted or dismounted by a user.

Embodiment 2

FIGS. 20–23 show the second embodiment of a development cartridge structured in accordance with the present invention.

The general structure of the development cartridge 4 in this embodiment is similar to that of the development cartridge 4 in the first embodiment, except that a plurality of development bias application electrodes 311A and 312A are attached to the guiding rib 310*b* on one of the lateral surfaces of the development cartridge 4. Therefore, the components in this embodiment similar in structural arrangement and function to those in the first embodiment will be given the same referential codes as the referential codes given to the corresponding components in the first embodiment, and their detailed descriptions will be omitted here.

In other word, in this embodiment, the end surface of the development cartridge 4 on the side from which the development cartridge 4 is driven, that is, on the side cover 310A side, is provided with: a first projection 310*h* for positioning the main assembly of the development cartridge in terms of its lengthwise direction; a positioning boss holding portion 310*c*; a second projection 310*a* for regulating the movement of the development cartridge 4 in the direction opposite to the first projection 310*h*; and a guiding rib 310*b* for guiding the development cartridge 4 to a predetermined position when inserting the development cartridge 4, as in the first embodiment. In this embodiment, however, the plurality of development bias application electrodes 311A and 312A are attached to the guiding rib 310*b*; in other words, at least development bias application contact points 311 and 312 are exposed at the end surface of the guiding rib 310*b*, that is, the surface of the guiding rib 310*b* perpendicular to the lengthwise direction the development cartridge 4.

These development bias application contact points 311 and 312 become electrically connected to the development bias application contact points 410 and 411 (FIG. 23) of the apparatus main assembly, as the development cartridge 4 is moved into the development position.

Figure 22:
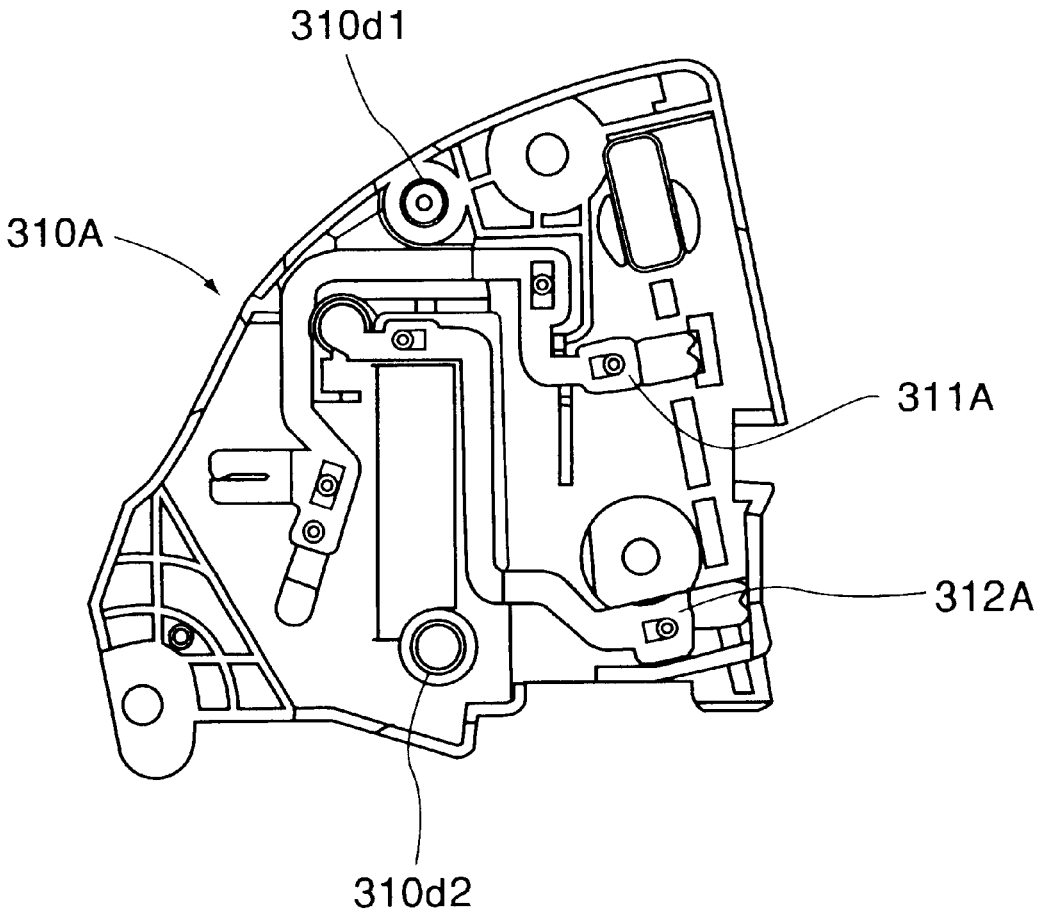
FIG. 22 is a front view showing a back side of a side cover of the developing cartridge of FIG. 20.
Figure 23:
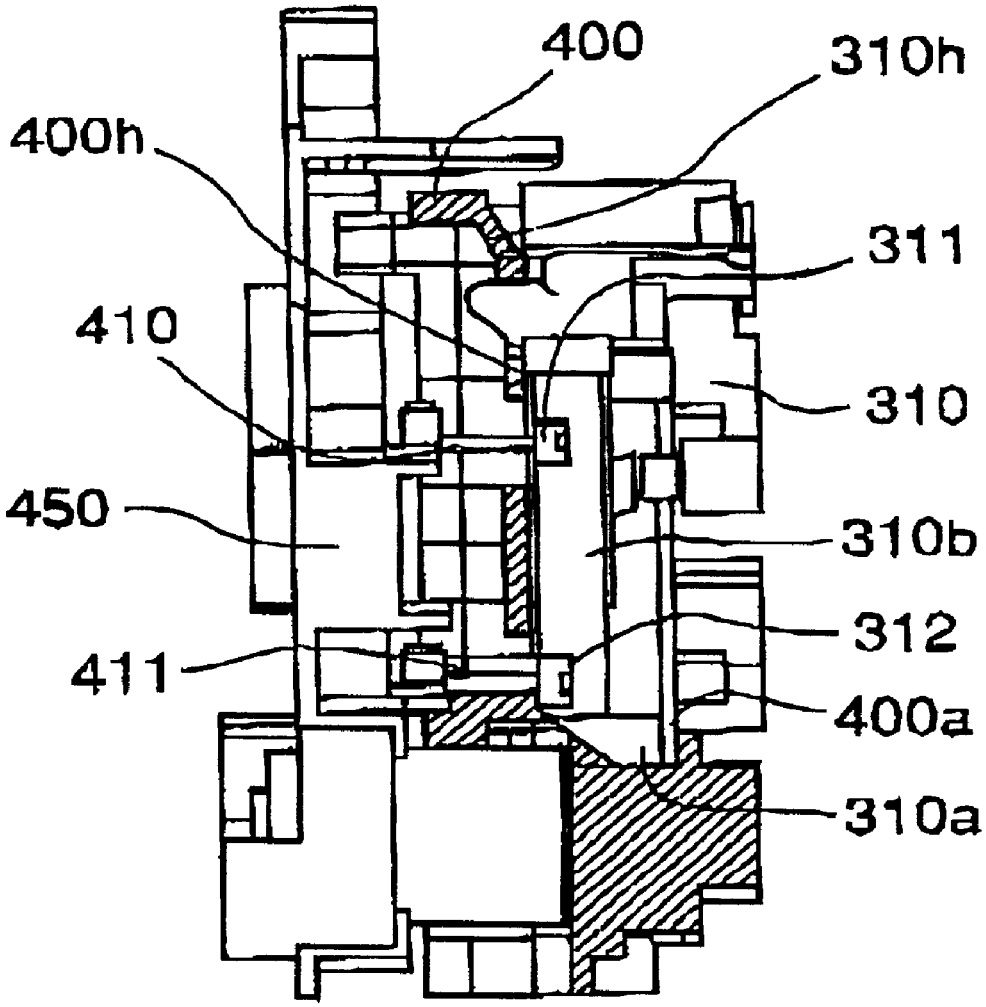
FIG. 23 a partially sectional view showing details of a non-driving side rotary disk to illustrate the positioning in the longitudinal direction between the developing cartridge and the rotary disk and electric connection between the electrical contacts of the main assembly apparatus and the developing cartridge, according to Embodiment 2.

In this embodiment, the development bias application electrode 311A comprising the development bias application contact point 311 is configured and laid out, as shown in FIG. 22, so that as the side cover 310A is attached to the development cartridge main assembly, it is electrically connected to the developing member 305 (development roller) and developer coating member 304 (toner supply roller) of the development cartridge 4, making it possible to apply development bias and coating member bias to the development roller 305 and toner supply roller 304, respectively. The development bias application electrode 312A comprising the development bias application contact point 312 is configured and laid out, as shown in FIG. 22, so that as the side cover 310A is attached to the development cartridge main assembly, it is electrically connected to the developer amount regulating member 332 (development blade) of the development cartridge 4, making it possible to apply the development amount regulating bias voltage to the development blade 332.

In this embodiment, the structure of the end plate, that is, the side cover 310B, of the development cartridge 4, on the side from which the development cartridge 4 is driven, is the same as that in the first embodiment, shown in FIG. 5.

In order to assure that the development cartridge 4 is placed in the predetermined position in the rotary 40, the length of the guiding rib 310*b* is made approximately the same as the radius of the development cartridge 4. In other words, the guiding rib 310*b* is long enough to be provided with a plurality of electrical contact points, making it possible to attach the plurality of electrical contact points so that their heights from the guiding rib 310*b* become equal, ensuring that the contact pressure between the electrical contact points of the apparatus main assembly side and the electrical contact points on the development cartridge side remains stable.

As for the operation for inserting the development cartridge 4 into the rotary 40, it is the same as that in the first embodiment.

Next, referring to FIG. 18 and FIG. 15, which is a sectional view of the development cartridges 4 in the predetermined positions in the rotary 40, as a given development cartridge 4 is driven by the image forming apparatus main assembly, the first projection 310*h* of the development cartridge 4 comes into contact with the cartridge catching portion 400*h* of the rotary 40, securing the predetermined distance between the development bias application contact points 410 and 411 of the apparatus main assembly, and the development cartridge 4. The movement of the development cartridge 4 in the opposite direction in terms of the lengthwise direction of the development cartridge 4 is regulated as the end surface of the second projection 310*a* attached to the development cartridge 4 comes into contact with the end surface of the regulating portion 400*a* of the groove of the rotary disc 400 of the apparatus main assembly.

In other words, also in this embodiment, a portion for regulating the movement of the development cartridge 4 in the opposite direction, that is, the regulating portion 400*a*, is provided. Therefore, even when the projection 310*h* of the development cartridge 4 fails to remain in contact with the cartridge catching portion 400*h* of the rotary 40 due to the fluctuation in the driving force, driving condition, and/or the like, the fluctuation of the distance between the development bias contact points 410 and 411 of the image forming apparatus main assembly and the development bias application contact points 311 and 312 of the development cartridge 4 is minimized.

Further, the two development bias application contact points 410 and 411 of the image forming apparatus main assembly in this embodiment are in the form of a coil spring, and are attached to the supporting plate 450 of the rotary 40.

To the two development bias application contact points 410 and 411 of the image forming apparatus main assembly, the development bias application contact points 311 and 312 of the development cartridge 4 are electrically connected, respectively.

The development bias application contact points 311 and 312 of the development cartridge 4 are attached to the guiding rib 310*b* on the non-driven side, with their top surfaces level with each other. Therefore, the fluctuation of the distances between the positioning projection 310*h* of the development cartridge 4, and the development bias application contact point 311, and between the positioning projection 310*h* of the development cartridge 4, and the development bias application contact point 312, remain within the range of the positional deviation of a single component traceable to the tolerance of the single component.

Further, as for the positional relationships between the development bias application contact point 410 of the image forming apparatus main assembly and the development bias application contact point 311 of the development cartridge 4, and between the development bias application contact point 411 of the image forming apparatus main assembly, and the development bias application contact point 312 of the development cartridge 4, the two development bias application contact points 410 and 411 of the image forming apparatus main assembly are connected to the two development bias application contact points 311 and 312 of the development cartridge 4, respectively, through the holes 400*c* of the rotary disk 400 of the rotary 40.

Therefore, the positional relationships between the development bias application contact point 410 of the image forming apparatus main assembly and the development bias application contact point 311 of the development cartridge 4, and between the development bias application contact point 411 of the image forming apparatus main assembly and the development bias application contact point 312 of the development cartridge 4, are determined by a smaller number of components, minimizing the amount of the error resulting from the addition of the tolerances of a plurality of components. In other words, the above described structural arrangement minimizes the alteration in the positional relationship between the development bias application contact points 410 and 411 of the image forming apparatus main assembly, and the development bias application contact points 311 and 312 of the development cartridge 4, respectively, ensuring that the development bias is reliably applied.

Further, not only is the rotary disc 400A, that is, the rotary disc 400 on the non-driven side, which is distant from the driving force input portion, provided with the driving force input gear 307 used to fix the position of the development cartridge 4 relative to the rotary 40, or the image forming apparatus main assembly, in terms of the lengthwise direction of the development cartridge 4, but also it is used to apply the development bias. Therefore, the positional relationships between the development bias application contact point 410 of the image forming apparatus main assembly and the development bias application contact point 311 of the development cartridge 4, and between the development bias application contact point 411 of the image forming apparatus main assembly and the development bias application contact point 312 of the development cartridge 4, are not likely to be affected by the positional deviation of the development cartridge 4 in the widthwise direction (direction perpendicular to lengthwise direction) of the development cartridge 4 caused by the force applied to drive the development cartridge 4; in other words, the positions of the development bias application contact points 410 and 411 of the image forming apparatus main assembly and the positions of the development bias application contact points 311 and 312 of the development cartridge 4 are likely to be kept stable, ensuring that the development bias is reliably applied.

In order to prevent the resin portion of the development cartridge 4 adjacent to the development bias application contact points 311 and 312 from being damaged, the development bias application contact points 311 and 312 of the development cartridge 4 need to be attached to the portions of the development cartridge 4 protruding slightly from the surfaces 310*i* and 310*j*.

In this embodiment, the development bias application contact points 311 and 312 of the development cartridge 4 are attached to the guiding rib 310*b* projecting slightly from the surfaces 310*i* and 310*j*, making it unnecessary to provide the surfaces 310*i* and 310*j* of the development cartridge 4 with protruding portions dedicated for the attachment of the development bias application contact points 311 and 312, contributing to spatial efficiency. In other words, the surfaces 310*i* and 310*j* in this embodiment do not have a portion which makes the development cartridge 4 hang up when inserting the development cartridge 4, allowing the development cartridge 4 to be smoothly inserted, improving therefore the efficiency with which the development cartridge 4 is mounted or dismounted by a user.

As described above, in this embodiment, the development cartridge 4 is provided with the positioning ribs, whereas the rotary of the image forming apparatus main assembly is provided with the grooves for positioning the development cartridge 4 in terms of the lengthwise direction of the development cartridge 4. Therefore, the distances between the development bias application contact point 410 of the apparatus main assembly and the development bias application contact point 311 of the development cartridge 4, and between the development bias application contact point 411 of the apparatus mairin assembly and the development bias application contact point 312 of the development cartridge 4, are kept virtually constant, ensuring that the development bias is reliably applied.

Further, not only is the positioning of the development cartridge 4 in terms of its lengthwise direction fixed on the non-driven side of the development cartridge 4, which is distant from the driving force input portion, but also the development bias is applied on the non-driven side. Therefore, the positional relationships between the development bias application contact points 411 and 412 of the image forming apparatus main assembly, and the development bias application contact points 311 and 312 of the development cartridge 4, respectively, are unlikely to be affected by the positional deviation of the development cartridge 4 in terms of its widthwise direction, ensuring that the development bias is reliably applied. Further, a plurality of development bias contact points can be attached to the guiding rib 310*b* with their top surfaces level with each other, making it possible to keep a predetermined amount of pressure applied to the plurality of contact points 311 and 312, ensuring that development bias is reliably applied.

Further, the contact points 311 and 312 are attached to the guiding rib 310*b* of the development cartridge 4, preventing the resin portion of the development cartridge 4 from being damaged during the rotation of the rotary 40, and also eliminating the need for providing the surfaces 310*i* and 310*j* with a portion protruding slightly therefrom, contributing to spacial efficiency. In other words, the surfaces 310*i* and 310*j* in this embodiment do not have a protruding contact point and the like, which makes the development cartridge 4 hang up when inserting the development cartridge 4, allowing the development cartridge 4 to be smoothly inserted, improving, therefore, the efficiency with which the development cartridge 4 is mounted or dismounted by a user.

As will be understood from the above description, and FIGS. 4 and 20, in the above described first and second embodiments, the development cartridge 4 is provided with the positioning rib comprising the guiding rib 310*b* and positioning projection 310*h* as the integral parts thereof, and the projection 310*a* for regulating the movement of the development cartridge 4 in terms of the lengthwise direction of the development cartridge 4, the position of which coincides with the theoretical extension of the positioning rib; in other words, the positioning portion 310*h*, guiding portion 310*b*, and the projection 310*a* for regulating the movement of the development cartridge 4 in terms of the lengthwise direction of the development cartridge 4, are aligned in a straight line.

Therefore, the positioning portion 310*h*, the guiding rib 310*b* to which the electrical contact points of the development cartridge 4 are attached, and the projection 310*a* for regulating the movement of the development cartridge 4 in terms of the lengthwise direction of the development cartridge 4, can be positioned with a high level of accuracy, making it possible to accurately position the electrical contact points in the image forming apparatus, therefore making it possible to reliably supply the development cartridge 4 with the biases.

Further, the positioning portion 310*c* having the cartridge catching portion 310*h*, shown in FIGS. 4 and 20, constitutes the axis about which the cartridge 4 pivots in the direction perpendicular to the axial line of the cartridge 4. Therefore, during the movement of the cartridge 4 into the development position after the mounting of the cartridge 4 into the rotary 40, the contact point 311 (312) can be moved to the bias supplying position, without being pressed upon the contact point 410 (411) fixed within the image forming apparatus main assembly. Also during this movement of the cartridge 4, the pressure catching portion 310*k* of the guiding rib 310*b* comes under the force generated by the resiliency of the spring 53 attached to the rotary 40, and the rotational moment generated by the force applied to rotationally drive the development roller 305, pressing, therefore, the projection 310*m* upon the surface of the projection catching recess 400*e*. As a result, the cartridge 4 restores its development attitude, and at the same time, the contact point 311 (312) on the guiding rib 310*b* settles in the bias supplying position.

The contact point 311 (312) is on the guiding rib 310*b*, and the positioning projection 310*c*, the path of which coincides with that of the contact point 311 (312), constitutes the pivotal center of the development cartridge 4. In addition, when the cartridge 4 is in the above described state, the pressure catching portion 310*k* of the guiding rib 310*b* catches the force generated by the resiliency of the spring 53, and the development cartridge 4 catches the rotational moment generated by the force applied to rotationally drive the development roller 305. Therefore, it is ensured that even after the movement of the development cartridge 4 into the development position, the contact point 311 (312) remains accurately positioned.

Further, the cartridge 4 is pivotable, allowing the contact point 311 (312) on the development cartridge 4 to be kept away from the contact point 410 (411) on the apparatus main assembly side while the development cartridge 4 is moved into the development position. Therefore, the shaving of the contact point 311 (312) and contact point 410 (411) caused by the intense friction among the contact points can be minimized.

Embodiment 3

Figure 24:
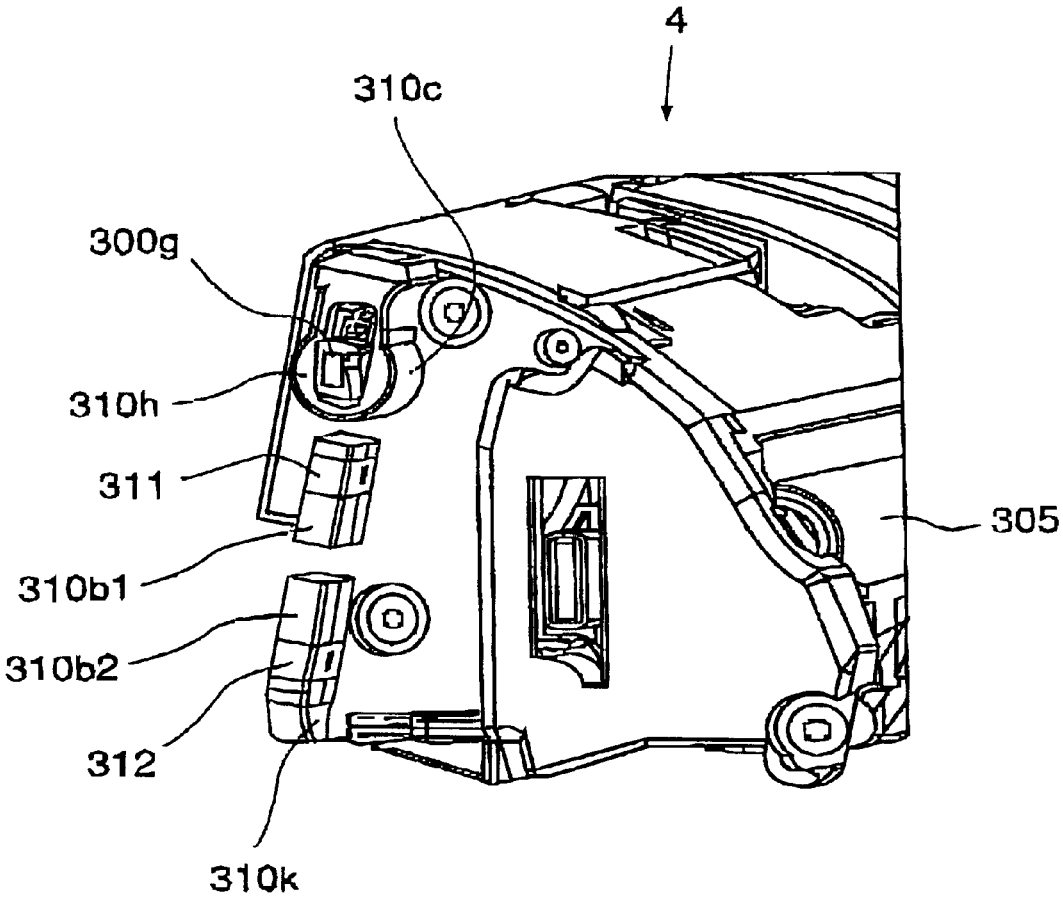
FIG. 24 is a partial perspective view of a developing cartridge according to Embodiment 3.

FIG. 24 shows another embodiment of the present invention. In the above described first and second embodiments, the first guide projecting from the end surface of the development cartridge 4 in tenms of the lengthwise direction, first projection 310*h*, positioning boss portion 310*c*, and guiding rib 310*b*, were integral parts of a single component.

In this embodiment, the guiding rib 310*b* comprises a first guiding rib 310*b*1 and a second guiding rib 310*b*2. The first guiding rib 310*b*1 is discrete from the first projection 310*h* as well as the second guiding rib 310*b*2. However, the first projection 310*h*, first guiding rib 310*b*1, and second guiding rib 310*b*2 are vertically aligned. Otherwise, the structure of the development cartridge 4 in this embodiment is identical to those in the first and second embodiments.

Further, in this embodiment, the development bias application contact points 311 and 312 are attached to the first and second guiding ribs 310*b*1 and 310*b*2, respectively.

An electrophotographic image forming apparatus employing a development cartridge in accordance with this embodiment can display the same operational effects as those displayed by the image forming apparatuses in the first and second embodiments.

Incidentally, in the preceding embodiments, the present invention was described with reference to a case in which the development cartridge 4 was mounted into the rotary 40 as a component representing the image forming apparatus main assembly. This, however, does not mean that the application of the present invention is limited to these embodiments. For example, the present invention is also applicable to an image forming apparatus, the main assembly of which comprises the top portion, and the bottom portion, from which the top portion can be opened or closed. When mounting the development cartridge 4 into such an image forming apparatus, the development cartridge 4 is to be mounted into the top portion, with the top portion opened from the bottom portion, and then, the top portion is closed onto the bottom portion. As the top portion is closed, the cartridge 4 is moved into the image forming position in the image forming apparatus main assembly. In this case, the structural arrangement of the image forming apparatus has only to be such that as the cartridge is moved into the image forming position, the development bias contact points attached to the bottom portion of the image forming apparatus main assembly come into contact with the development bias contact points on the cartridge side, and that the developer amount regulating bias contact point attached to the bottom portion comes into contact with the developer amount regulation bias contact point on the cartridge side. Further, the image forming position in this case is equivalent to the above described developing position.

The present invention is also applicable to an image forming apparatus, the main assembly of which comprises a drawer which can be pulled out of the main assembly. In this case, the drawer and main assembly are equivalent to the top and bottom portions of the main assembly of the preceding example of an image forming apparatus to which the present invention is applicable.

Further, in the preceding embodiments of the present invention, a cartridge was described with reference to a development cartridge. However, the preceding embodiments are not intended to limit the application of the present invention. For example, the present invention is also applicable to a process cartridge. Further, the application of the present invention is not limited to such a development cartridge as the development cartridge in the preceding embodiments, which comprises a developing member, a developer storage portion for storing the developer used by the developing member for developing an electrostatic latent image, and a housing, or a cartridge, in which the preceding components are integrally disposed so that they can be removably mounted into the apparatus main assembly. Further, a development cartridge does not need to have the developer storage portion, or may comprise other components than the above listed ones. A process cartridge means a cartridge in which an electrophotographic photoconductive member and the aforementioned developing member are integrally disposed, and which is removably mounted into the image forming apparatus main assembly, or a cartridge in which an electrophotographic photoconductive member, a developing member, and either a charging member or a cleaning member, are integrally disposed, and which is removably mountable in the image forming apparatus main assembly.

Effects of Invention

As described above, the present invention ensures that the distance between the development bias application contact point (points) on the image forming apparatus main assembly side and the development bias application contact point (points) on the cartridge side is accurately set and remains accurately set so that the contact pressure between the contact points is set to a predetermined level and remains at the predetermined level. In addition, the present invention improves the operability of an image forming apparatus, or the efficiency with which an image forming apparatus is operable by a user.

While the invention has been described with reference to the structures disclosed herein, it is not confined to the details set forth, and this application is intended to cover such modifications or changes as may come within the purposes of the improvements or the scope of the following claims.

What is claimed is:

1. A cartridge detachably mountable to a main assembly of an electrophotographic image forming apparatus, said cartridge comprising:

a cartridge frame;

a developing member configured and positioned to develop an electrostatic latent image formed on an electrophotographic photosensitive member;

a first guide, projecting outwardly of said cartridge frame at one longitudinal end side of said developing member, configured and positioned to guide said cartridge when said cartridge is mounted to the main assembly of the apparatus;

a second guide, projecting outwardly of said cartridge frame at the other longitudinal end side of said developing member, configured and positioned to guide said cartridge when said cartridge is mounted to the main assembly of the apparatus, and a developing bias contact, provided to be exposed on said first guide, configured and positioned to receive a developing bias to be applied to said developing member from the main assembly of the apparatus when said cartridge is mounted to the main assembly of the apparatus.

2. A cartridge according to claim 1, wherein said first guide comprises a positioning portion to be positioned relative to the main assembly of the apparatus when said cartridge is mounted to the main assembly of the apparatus, and a portion to be positioned which contacted to contacts the main assembly of the apparatus when said cartridge is rotated about said positioning portion by an urging force imparted to said cartridge when a driving force for rotating said developing member is transmitted to said cartridge from the main assembly of the apparatus.

3. A cartridge according to claim 2, wherein said portion to be positioned is provided on a bottom surface of said cartridge frame at each of one and the other longitudinal ends of said developing member.

4. A cartridge according to claim 2 or 3, wherein said positioning portion takes an upper position when said cartridge is mounted to the main assembly of the apparatus, is disposed at one end side of said first guide, wherein an urging force receiving portion takes a lower position when said cartridge is mounted to the main assembly of the apparatus, is disposed at the other end side of said first guide, and wherein said developing bias contact is disposed between said positioning portion and the urging force receiving portion.

5. A cartridge according to claim 4, wherein said cartridge further comprises a developer application member configured and positioned to apply a developer on a surface of said developing member, and wherein when said cartridge is mounted to the main assembly of the apparatus, said developing bias contact receives, in addition to the developing bias an application member bias to be applied to said developer application member from the main assembly of the apparatus.

6. A cartridge according to claim 4, wherein said cartridge further includes a developer amount regulating member configured and positioned to regulate the amount of the developer deposited on a surface of said developing member, a developer amount regulating member electrical contact, exposed on said first guide at a portion which takes a position below said developing bias contact when said cartridge is mounted to the main assembly of the apparatus, configured and positioned to receive a developer amount regulating member bias to be applied to said developer amount regulating member from the main assembly of the apparatus when said cartridge is mounted to the main assembly of the apparatus.

7. A cartridge according to claim 6, wherein said first guide comprises a flat-plate-like portion and an arcuate portion at an end of said flat-plate-like portion, wherein the urging force receiving portion is provided on said flat-plate-like portion, and said positioning portion is provided on said arcuate portion, wherein said developing bias contact is mounted to said flat-plate-like portion, and said developing bias contact and said developer amount regulating member electrical contact are disposed on a longitudinal end surface of said developing member.

8. A cartridge according to claim 7, wherein said second guide has flat-plate-like portion and an arcuate portion at an end of said flat-plate-like portion, and when said cartridge is mounted to the main assembly of the apparatus, said arcuate portion of said second guide is roughly positioned to the main assembly of the apparatus, wherein said arcuate portion of said first guide is positioned to the main assembly of the apparatus more accurately than said arcuate portion of said second guide.

9. A cartridge according to claim 4, wherein said first guide is made of a resin material, and said positioning portion and the urging force receiving portion are integrally molded.

10. A cartridge according to claim 4, wherein said cartridge further comprises a driving force receiving portion configured and positioned to receive a driving force for rotating said developing member from the main assembly of the apparatus when said cartridge is mounted to the main assembly of the apparatus, wherein said driving force receiving portion is disposed at the other longitudinal end side of said developing member.

11. A cartridge according to claim 10, wherein said driving force receiving portion includes a helical gear which is rotated through meshing engagement with a helical gear provided in the main assembly of the apparatus when said cartridge is mounted to the main assembly of the apparatus to urge said cartridge toward one longitudinal end of said cartridge.

12. A cartridge according to claim 4, further comprising a developer accommodating portion wherein said cartridge is a black developing cartridge accommodating a black developer in said developer accommodating portion, a yellow developing cartridge accommodating a yellow developer in said developer accommodating portion, a magenta developing cartridge accommodating a magenta developer in said developer accommodating portion, or a cyan developing cartridge accommodating a cyan developer in said developer accommodating portion, wherein said black developing cartridge, said yellow developing cartridge, said magenta developing cartridge and said cyan developing cartridge are detachably mountable to a rotatable rotary member which is in the main assembly of the apparatus, and wherein when said rotary member rotates to a predetermined position, said cartridges are electrically connected to a common main assembly developing bias electrical contact.

13. A cartridge according to claim 4, wherein said cartridge is a process cartridge further comprising the electrophotographic photosensitive member.

14. An electrophotographic image forming apparatus for forming an image on a recording material, having a main assembly to which a cartridge is detachably mountable, said apparatus comprising:

(i) a cartridge mounting portion configured and positioned to detachably mount the cartridge, the cartridge including:

a cartridge frame;

a developing member configured and positioned to develop an electrostatic latent image formed on an electrophotographic photosensitive member;

a first guide, projecting outwardly of the cartridge frame at one longitudinal end side of the developing member, configured and positioned to guide the cartridge when the cartridge is mounted to the main assembly of said apparatus;

a second guide, projecting outwardly of the cartridge frame at the other longitudinal end side of the developing member, configured and positioned to guide the cartridge when the cartridge is mounted to the main assembly of said apparatus; and a developing bias contact, exposed on the first guide, configured and positioned to receive a developing bias to be applied to the developing member from the main assembly of said apparatus when the cartridge is mounted to the main assembly of said apparatus; and (ii) feeding means for feeding the recording material.

15. An apparatus according to claim 14, further comprising a developer accommodating portion, wherein said mounting portion is provided in a rotatable rotary member, wherein said rotary member has a first mounting portion configured and positioned to mount a black developing cartridge, accommodating a black developer in said developer accommodating portion, a second mounting portion configured and positioned to mount a yellow developing cartridge accommodating a yellow developer in said developer accommodating portion, a third mounting portion configured and positioned to mount a magenta developing cartridge accommodating a magenta developer in said developer accommodating portion, and a fourth mounting portion configured and positioned to mount a cyan developing cartridge accommodating a cyan developer in said developer accommodating portion, wherein said rotary member is rotatable to sequentially place the developing cartridges to a development position which is opposed to the electrophotographic photosensitive member, which is provided in the main assembly of said apparatus, and said rotary member is provided with a main assembly developing bias contact which is electrically connected with the developing bias contact provided in the cartridge.

16. A cartridge detachably mountable to a main assembly of an electrophotographic image forming apparatus, said cartridge comprising:

a cartridge frame;

a developing member configured and positioned to develop an electrostatic latent image formed on an electrophotographic photosensitive member;

a first guide, projecting outwardly of said cartridge frame at one longitudinal end side of said developing member, configured and positioned to guide said cartridge when said cartridge is mounted to the main assembly of the apparatus;

a second guide, projecting outwardly of said cartridge frame at the other longitudinal end side of said developing member, configured and positioned to guide said cartridge when said cartridge is mounted to the main assembly of the apparatus; and a developing bias contact, exposed on said first guide, configured and positioned to receive a developing bias to be applied to said developing member from the main assembly of the apparatus when said cartridge is mounted to the main assembly of the apparatus, wherein said first guide comprises a positioning portion to be positioned relative to the main assembly of the apparatus when said cartridge is mounted to the main assembly of the apparatus, and a portion to be positioned which contacts the main assembly of the apparatus when said cartridge is rotated about said positioning portion by an urging force imparted to said cartridge when a driving force for rotating said developing member is transmitted to said cartridge from the main assembly of the apparatus, wherein said portion to be positioned is provided on a bottom surface of said cartridge frame at each of one and the other longitudinal ends of said developing member, wherein said positioning portion takes an upper position when said cartridge is mounted to the main assembly of the apparatus, and is disposed at one end side of said first guide, wherein an urging force receiving portion takes a lower position when said cartridge is mounted to the main assembly of the apparatus, and is disposed at the other end side of said first guide and wherein said developing bias contact is disposed between said positioning portion and the urging force receiving portion, wherein said cartridge further comprises a developer application member configured and positioned to apply a developer on a surface of said developing member, and when said cartridge is mounted to the main assembly of the apparatus, said developing bias contact receives, in addition to the developing bias, an application member bias to be applied to said developer application member from the main assembly of the apparatus, wherein said cartridge further includes a developer amount regulating member configured and positioned to regulate the amount of the developer deposited on a surface of said developing member, and a developer amount regulating member electrical contact, exposed on said first guide at a portion which takes a position below said developing bias contact when said cartridge is mounted to the main assembly of the apparatus, configured and positioned to receive a developer amount regulating member bias to be applied to said developer amount regulating member from the main assembly of the apparatus when said cartridge is mounted to the main assembly of the apparatus, and wherein said cartridge further comprises a driving force receiving portion configured and positioned to receive a driving force for rotating said developing member from the main assembly of the apparatus when said cartridge is mounted to the main assembly of the apparatus, wherein said driving force receiving portion is disposed at the other longitudinal end side of said developing member.

17. A cartridge according to claim 16, wherein said first guide comprises a flat-plate-like portion and an arcuate portion at an end of said flat-plate-like portion, wherein the urging force receiving portion is provided on said flat-plate-like portion, and said positioning portion is provided on said arcuate portion of said first guide, wherein said developing bias contact is mounted to said flat-plate-like portion, and said developing bias contact and said developer amount regulating member electrical contact are disposed on a longitudinal end surface of said developing member.

18. A cartridge according to claim 17, wherein said second guide comprises a flat-plate-like portion and an arcuate portion at an end of said flat-plate like portion, and when said cartridge is mounted to the main assembly of the apparatus, said arcuate portion of said second guide is roughly positioned to the main assembly of the apparatus, wherein said arcuate portion of said first guide is positioned to the main assembly of the apparatus more accurately than said arcuate portion of said second guide.

19. An electrophotographic image forming apparatus for forming an image on a recording material, having a main assembly to which a cartridge is detachably mountable, said apparatus comprising:

(i) a cartridge mounting portion configured and positioned to detachably mount the cartridge, the cartridge including:

a cartridge frame;

a developing member configured and positioned to develop an electrostatic latent image formed on an electrophotographic photosensitive member;

a first guide, projecting outwardly of the cartridge frame at one longitudinal end side of the developing member, configured and positioned to guide the cartridge when the cartridge is mounted to the main assembly of said apparatus;

a second guide, projecting outwardly of the cartridge frame at the other longitudinal end side of the developing member, configured and positioned to guide the cartridge when the cartridge is mounted to the main assembly of said apparatus; and a developing bias contact, exposed on the first guide, configured and positioned to receive a developing bias to be applied to the developing member from the main assembly of said apparatus when the cartridge is mounted to the main assembly of said apparatus, wherein the first guide comprises a positioning portion to be positioned relative to the main assembly of said apparatus when the cartridge is mounted to the main assembly of said apparatus, and a portion to be positioned which contacts the main assembly of said apparatus when the cartridge is rotated about the positioning portion by an urging force imparted to the cartridge when a driving force for rotating the developing member is transmitted to the cartridge from the main assembly of said apparatus, wherein said portion to be positioned is provided on a bottom surface of the cartridge frame at each of one and the other longitudinal ends of the developing member, wherein said positioning portion takes an upper position when the cartridge is mounted to the main assembly of said apparatus, and is disposed at one end side of the first guide, wherein an urging force receiving portion takes a lower position, lower than the upper position, when the cartridge is mounted to the main assembly of said apparatus, and is disposed at the other end side of the first guide, and wherein said developing bias contact is disposed between said positioning portion and the urging force receiving portion, wherein said cartridge further comprises a developer application member configured and positioned to apply a developer on a surface of the developing member, and when the cartridge is mounted to the main assembly of said apparatus, the developing bias contact receives, in addition to the developing bias, an application member bias to be applied to the developer application member from the main assembly of said apparatus, wherein said cartridge further includes a developer amount regulating member configured and positioned to regulate the amount of the developer deposited on a surface of the developing member, and a developer amount regulating member electrical contact, exposed on the first guide at a portion which takes a position below said developing bias contact when the cartridge is mounted to the main assembly of said apparatus, configured and positioned to receive a developer amount regulating member bias to be applied to said developer amount regulating member from the main assembly of said apparatus when the cartridge is mounted to the main assembly of said apparatus, wherein said cartridge further comprises a driving force receiving portion configured and positioned to receive a driving force for rotating the developing member from the main assembly of said apparatus when the cartridge is mounted to the main assembly of said apparatus, wherein said driving force receiving portion is disposed at the other longitudinal end side of the developing member; and (ii) feeding means for feeding the recording material.

20. An apparatus according to claim 19, wherein the cartridge further includes a developer accommodating portion, wherein said mounting portion is provided in a rotatable rotary member, wherein said rotary member has a first mounting portion configured and positioned to mount a black developing cartridge accommodating a black developer in the developer accommodating portion, a second mounting portion configured and positioned to mount a yellow developing cartridge accommodating a yellow developer in the developer accommodating portion, a third mounting portion configured and positioned to mount a magenta developing cartridge accommodating a magenta developer in the developer accommodating portion, and a fourth mounting portion configured and positioned to mount a cyan developing cartridge accommodating a cyan developer in the developer accommodating portion, wherein the rotary member is rotatable to sequentially place the developing cartridges to a development position which is opposed to the electrophotographic photosensitive member provided in the main assembly of said apparatus, and said rotary member is provided with a main assembly developing bias contact which is electrically connected with the developing bias contact provided in the cartridge.

21. A cartridge detachably mountable to a main assembly of an electrophotographic image forming apparatus, said cartridge comprising:

a cartridge frame;

a developing roller configured and positioned to develop an electrostatic latent image formed on an electrophotographic photosensitive drum;

a first guide portion, projecting outwardly of said cartridge frame at one longitudinal end side of said cartridge frame, configured and positioned to guide said cartridge when said cartridge is mounted to the main assembly of the apparatus, wherein said first guide portion is guided by a groove provided in the main assembly of the apparatus;

a second guide portion, projecting outwardly of said cartridge frame at the other longitudinal end side of said cartridge frame, configured and positioned to guide said cartridge when said cartridge is mounted to the main assembly of the apparatus, wherein said second guide portion is guided by a groove provided in the main assembly of the apparatus; and a developing bias contact, provided to be exposed through an end surface of said first guide portion, configured and positioned to receive a developing bias to be applied to said developing roller from the main assembly of the apparatus when said cartridge is mounted to the main assembly of the apparatus.

* * * * *

UNITED STATES PATENT AND TRADEMARK OFFICE

CERTIFICATE OF CORRECTION

PATENT NO. : 6,782,219 B2
DATED : August 24, 2004
INVENTOR(S) : Yasufumi Yoshino et al.

It is certified that error appears in the above-identified patent and that said Letters Patent is hereby corrected as shown below:

Column 1,
Line 57, “a” (first occurrence) should read -- are --.

Column 11,
Line 33, “in” should be deleted.

Column 12,
Line 6, “described more” should read -- further described --.

Column 15,
Line 42, “word” should read -- words --.

Column 22,
Line 5, “contacted to” should be deleted.
Line 33, “bias” should read -- bias, --.

Column 23,
Line 21, “portion” should read -- portion, --.

Signed and Sealed this

Second Day of November, 2004

JON W. DUDAS
*Director of the United States Patent and Trademark Office*